United States Patent [19]

Porter et al.

[11] Patent Number: 4,976,090

[45] Date of Patent: Dec. 11, 1990

[54] AUTOMATIC BOTTLE BAGGER

[75] Inventors: Bryan K. Porter, Jenison; Marvin J. Jakubiak, Kentwood; Jerry A. Bott, Grand Rapids, all of Mich.

[73] Assignee: Automatic Inspection Systems, Inc., Grand Rapids, Mich.

[21] Appl. No.: 494,930

[22] Filed: Mar. 14, 1990

Related U.S. Application Data

[63] Continuation of Ser. No. 141,007, Jan. 5, 1988, abandoned.

[51] Int. Cl.[5] ..... B65B 35/44; B65B 35/54; B65B 43/34

[52] U.S. Cl. ..... 53/448; 53/459; 53/469; 53/500; 53/543; 53/570

[58] Field of Search ..... 53/448, 543, 154, 155, 53/202, 443, 469, 459, 570, 572, 537, 499, 500, 501; 198/431

[56] References Cited

U.S. PATENT DOCUMENTS

| | | | |
|---|---|---|---|
| 2,470,795 | 5/1949 | Socke . | |
| 2,613,021 | 10/1952 | Bowes . | |
| 2,633,280 | 3/1953 | Davies | 53/448 X |
| 2,684,799 | 7/1954 | Holstein . | |
| 2,703,182 | 3/1955 | Broberg et al. . | |
| 2,738,116 | 3/1956 | Barraclough . | |
| 2,739,718 | 3/1956 | Birchall . | |
| 2,858,656 | 11/1958 | Curry | 53/543 |
| 2,956,381 | 10/1960 | Chauvin et al. . | |
| 2,969,629 | 1/1961 | Blais | 53/155 X |
| 3,119,213 | 1/1964 | Kinney | 53/448 X |
| 3,301,376 | 1/1967 | Winter, IV et al. . | |
| 3,473,289 | 10/1969 | Vadas | 53/154 X |
| 3,802,154 | 4/1974 | Dillon | 53/154 |
| 3,877,562 | 4/1975 | Smaw . | |
| 3,887,060 | 6/1975 | Kamphues . | |
| 4,018,031 | 4/1977 | Smaw | 53/572 X |
| 4,231,697 | 11/1980 | Franz . | |
| 4,263,769 | 4/1981 | Hanazawa et al. | 53/448 |
| 4,419,854 | 12/1983 | Okada et al. | 53/570 X |
| 4,439,084 | 3/1984 | Werkheiser . | |
| 4,589,812 | 5/1986 | Meives et al. . | |
| 4,768,329 | 9/1988 | Borrow | 53/543 |

*Primary Examiner*—Horace M. Culver

*Attorney, Agent, or Firm*—Varnum, Riddering, Schmidt & Howlett

[57] ABSTRACT

A bagger (10) for packaging a plurality of bottles (12, 14) in plastic bags (20) comprises a main table assembly (28) and a main pusher assembly (30) at said main table assembly (28). The bagger (10) also includes a pair of identical side table assemblies (31, 33) at opposite sides (150) of the main table assembly (28), each of said table assemblies (31, 33) having a side pusher assembly (32). The bagger (10) further includes a bag holder assembly (42) and a sealing assembly (40). In operation, a bag (20) is first placed on the bag holder assembly (42). A group of bottles (12) is fed by a conveyor (16) to one side table assembly (31). A group of bottles (14) is fed by conveyor (18) to the other side table assembly (33). Subsequently, the group of bottles (12) at the one side table assembly (31) is moved by the respective side pusher assembly (32) to the main table assembly (28) and then moved by the main pusher assembly (30) into the bag (20) alternately with the group of bottles (14) at the other side table assembly (33). The sealing assembly seals the bags (20) after they have been filled with the group of bottles (12, 14).

40 Claims, 9 Drawing Sheets

AUTOMATIC BOTTLE BAGGER

This is a continuation, of application Ser. No. 141,007 filed Jan. 5, 1988 and now abandoned.

FIELD OF THE INVENTION

The invention relates to an apparatus for packaging plastic bottles in plastic bags. More specifically, the invention relates to an apparatus used by manufacturers of "blow molded" plastic milk bottles and which automatically packages the bottles in plastic bags so that they can thereafter be conveniently stores or shipped to dairies for filling with milk.

BACKGROUND OF THE INVENTION

Apparati for use in packaging plastic bottles in plastic bags are known. For example, a manual-operated bagger comprises a loading platform, a plurality of vertical walls framing the platform and a roller rotatably mounting a roll of plastic bags. In operation, rows of bottles are positioned on the platform within the confines of the vertical walls and thereafter cardboard is placed on the tops of the bottles. A second layer of bottles is then positioned on top of the cardboard and a second cardboard is set on the tops of the second layer of bottles. This process of stacking layers of bottles separated by layers of cardboard continues until the platform is filled. Thereafter, the roller is rotated and a plastic bag is drawn off the roll and over the vertical walls and the platform. The platform is then rotated and the bag packaging the bottles is removed out of engagement from the walls and the platform. Once so removed, the open end of the bag is sealed by a suitable mechanical means.

The principal drawback of the manual bagger is its inefficiency. Since the bagger is manually operated, the speed at which bottles can be bagged is limited to the speed at which the operating can operate the bagger. In addition, the bottles bagged by the bagger are subjected to unsanitary conditions. The cardboard used in the bagging process is associated with dirt and dust which inevitably contaminates the interior of the bottles. This presents a sanitation problem for those in the dairy industry wherein bottles packaged by the bagger are shipped to dairies for filling with milk. If the bottles are contaminated, the dairies are required to clean the bottles prior to the filling process. This cleaning process is relatively expensive. Further, the cardboard is an expense which could be avoided.

Another bottle bagger currently available is manufactured by Dyco, Inc., of Berwick, Penna. This bagger comprises first and second platforms set in offset juxtaposition with respect to one another. The first platform has a first end and a second end and a first pusher is movable between the first and second ends. The second platform has first and second sides and a second pusher is movable between the second end of the first platform and the first side of the second platform. A third pusher is movable between the first and second sides of the second platform. The bagger also includes bag holder and sealing assemblies positioned midway between the first and second sides of the second platform. The bag holder assembly holds a bag such that the opened end of the same faces the first side of the second platform. In operation, bottles are first fed seriatim by a conveyor onto the first end of the first platform until a row of bottles is allowed to accumulate thereon. The row is then moved onto the second end of the first platform by the first pusher. After a predetermined number of rows of bottles have so accumulated on the second end of the first platform, the second pusher moves the rows of bottles laterally from the second end of the first platform to the first side of the second platform. The third pusher then forces the bottles into the bag. Sealing jaws of the sealing assembly subsequently close the open end of the bag and a pair of heated wires on the jaws seal the bag and sever excess plastic of the bag at the seal. The sealed bag packaging the bottles is thereafter moved off the second side of the second platform for storage or shipping.

The main drawback of the Dyco bagger is its inefficiency. As stated above, each row of bottles fed onto the first end of the first platform is individually pushed by the first pusher the full distance between the first and second ends of the first platform. This process of accumulating a plurality of rows of bottles on the second end of the first platform is time consuming.

To improve the speed at which a bagger can accumulate a plurality of rows of bottles so that they can thereafter be pushed into a bag for packaging, it has been found desirable to push each row of bottles fed onto a first end of a platform a relatively short distance sufficient to allow another row of bottles to be loaded onto the first end of the platform. These short movements of a pusher on the first end of the platform would continue until a predetermined number of rows of bottles accumulate on the first end whereupon the pusher then forces the accumulated rows the full distance to a second end of the first platform for loading into the bag. It has been found that this latter process is twice as fast as the former process of pushing each row of bottles individually from one end of a platform to another end of the same. A packaging machine of this type, i.e., wherein individual rows of articles are successively pushed downstream on a platform a relatively short distance by a pusher and thereafter pushed into a bag, is disclosed in Bowes U.S. Pat. No. 2,613,021, issued Oct. 7, 1952. Applicants' assignee's copending U.S. patent application Ser. No. 880,127 for an Automatic Bottle Bagger discloses a similar apparatus.

To further improve the speed at which a packaging apparatus can bag articles, it has been found desirable to provide a bagger wherein rows of bottles are accumulated on a pair of side platforms in the desired manner described above and thereafter alternately moved onto a central platform and pushed into plastic bags. This bagger also permits the alternate bagging of bottles of different type from the two side platforms.

SUMMARY OF THE INVENTION

According to the invention there is provided an apparatus for packaging articles into a bag having an open end. The apparatus comprises upstream and downstream portions, table means for supporting the articles, conveyor means for feeding articles to the table means at the upstream portion of the apparatus, bag holder means at the downstream portion for supporting the bag, pusher means for forcing the articles from the upstream portion to the downstream portion and into the bag, sealing means at the downstream portion for sealing the bag open end, and control means for coordinating movement of the pusher means, the bag holder means and the sealing means.

The table means comprises a center table and a pair of side tables positioned at opposite longitudinal sides of the center table. The conveyor means is adapted to feed a group of articles to each of the side tables. The pusher means includes a center pusher at the center table, and a pair of side pushers at the side tables. The side pushers are positioned in opposing relationship and are movable toward and away from the center table. The center pusher is positioned between the side pusher and is movable between upstream and downstream positions in a direction normal to directional movement of the side pushers.

The control means is adapted to coordinate movement of the center pusher and the side pushers whereby a group of articles fed by the conveyor to one of the side tables is moved by the respective side pusher to the center table and by the center pusher downstream and into the bag alternatively with a group of articles fed by the conveyor means to the other of the side tables.

The conveyor means is further adapted to feed articles to each of the side tables seriatim to form a row of articles on each of the side tables. In addition, the control means is further adapted to move each side pusher a relatively short distance on the respective side table to move a first row of articles a sufficient distance to enable a second row of articles to be fed to the side table just upstream of the first row, whereby a predetermined number of rows can be grouped on the side table prior to the group being moved by the side pusher to the center table.

In one embodiment of the invention, the control means is further adapted to actuate movement of one of the side pushers to move successive groups of rows of articles from the respective side table to the center table prior to actuating movement of the other of the side pushers.

The control means further comprises a counter means for counting the relatively short distance movements of each side pusher. The control means is further adapted to actuate movement of each side pusher a relatively long distance to move a group of rows of articles from the respective side table to the center table after a predetermined number of counts of the counter means.

The apparatus also includes gate means at each of the opposite longitudinal sides of the center table. The gate means is movable between raised and lower positioned to obstruct and permit, respectively, movement of the articles from the respective side table to the center table. The control means is also adapted to actuate movement of each of the gate means from the raised position to the lower position, prior to movement of the respective side pushers the relatively long distance, and subsequently from the lower position to the raised position when the side pusher moves upstream after its downstream relatively long distance movement.

The sealing means comprises a pair of opposed sealing jaws positioned adjacent to the bag open end, and means for opening the sealing jaws for movement between an open position where the jaws are positioned in spaced-apart relationship and a clamping position where the jaws engage one another. The control means is adapted to actuate movement of the sealing jaws from the open position to the clamping position under a first pressure after the center pusher moves to the downstream position.

The apparatus further comprises a detection means for detecting the presence of the sealing jaws in the clamping position. The control means is operatively connected to the detection means and responds to the detected presence of the sealing jaws in the clamping position to drive the sealing jaws together under a second pressure greater than the first pressure. The sealing means further comprises a thermal severing means for applying heat to the open end of the bag to seal the bag and sever excess material from the bag at the seal. The control means is responsive to the detected presence of the sealing jaws in the clamping position to activate the thermal severing means to apply heat to the bag.

The bag holder means is positioned upstream of the sealing means and comprises an upper holder means holding an upper portion of the bag above the center table and a lower holder means for holding a lower portion of the bag below the center table. The lower holder means comprises feet means movable between a bottom position where the feet means are out of engagement with the center table and a top position where the feet means engage the center table for securely clamping the lower portion of the bag between the center table and the feet means. The upper holder means further comprises bucket means pivotal between an lower position where the bucket means is adapted to receive the upper portion of the bag and an upper position where the bucket means securely holds the upper portion of the bag above the center table. The control means is adapted to actuate movement of the feet and bucket means between the bottom and lower positions and the top and upper positions, respectively. The control means further includes a manually operated foot switch means for actuating movement of the feet and bucket means to the bottom and lower positions, respectively, when the foot switch means is activated and to move the feet and bucket means to the top and upper positions, respectively, when the foot switch means deactivated.

According to the invention there is also provided a method for loading articles into a bag having an open end. The method comprises first feeding the articles in groups to a pair of side stations positioned on opposite sides of a center station. Subsequently, a group of articles from one of the side stations is moved in a first direction to the center station and from the center station in a second direction normal to the first direction into a bag alternatively with a group of the articles from the other of the side stations.

BRIEF DESCRIPTION OF THE DRAWINGS

Reference will now be made to the drawings in which.

DESCRIPTION OF THE PREFERRED EMBODIMENTS

Figure 1:
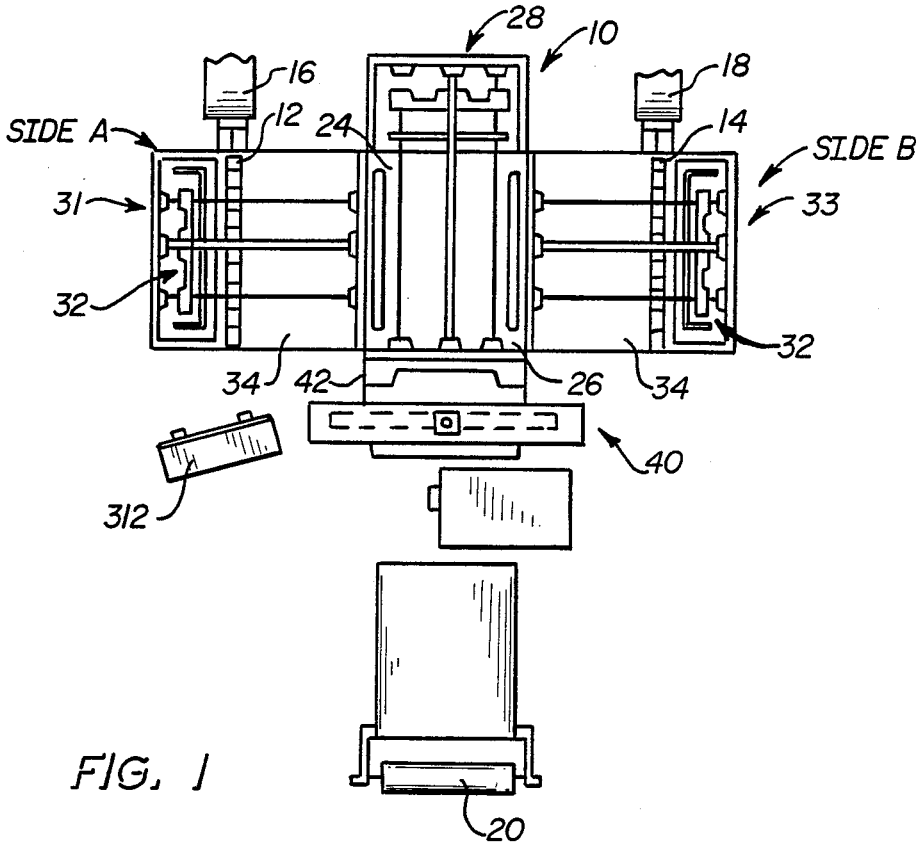
FIG. 1 is a plan view of a bottle bagger according to the invention.

Referring now to the drawings in detail and in particular to FIG. 1, there is shown a bottle bagger for bagging or packaging bottles 12, 14 in plastic bags 20 so that the packaged bottles can thereafter be practically and conveniently shipped for filling and stored in sanitary conditions. Although the bagger 10 is particularly adapted for use in packaging blow-molded plastic bottles, a wide variety of containers can be packaged utilizing the bagger 10 of the invention.

For purposes of explanation, elements of the bagger 10 will often be referred to as having upstream and downstream portions, and certain elements of the bagger will be referred to as being positioned upstream or downstream relative to other elements of the bagger 10, movement of bottles 12, 14 on the bagger 10 being from upstream to downstream portions thereof.

The bagger 10 generally comprises a main table assembly 28 having upstream and downstream portions 24, 26, a main push off plate 136 and a main pusher assembly 30. The bagger further comprises identical first and second side table assemblies 31, 33 (hereinafter sometimes referred to generally as sides A and B, respectively). Each side table assembly comprises a pusher assembly 32 and a push off plate 34. The bagger 10 further comprises a sealing assembly 40 and a bag holder assembly 42. The sealing and bag holder assemblies are of the type disclosed in Applicants' assignee's copending U.S. patent application Ser. No. 880,127 for an Automatic Bottle Bagger.

In operation of the bagger 10, as described in great detail below, a pair of conveyors 16, 18 feed bottles 12, 14 of different type seriatim onto the side A and B push off plates 34, respectively. In this manner, a row of bottles is formed on each side push off plate 34. The side pusher assemblies then repetitiously move relatively short distances to form accumulated rows of bottles 12, 14 on the respective side plates 34. Subsequently, the accumulated rows on one side plate 34 are moved by the respective side pusher assembly to the main plate and moved by the main pusher assembly 30 into a bag 20 alternately with the accumulated rows on the other side table plate 34. In this manner, the bagger 10 has the capability of bagging two different types of bottles, for example, differing in size, in successive operations. Also, in this manner, bottles 12, 14 fed onto the opposite side plates 34 preferably are not mixed during any one single bagging operation.

Figure 2:
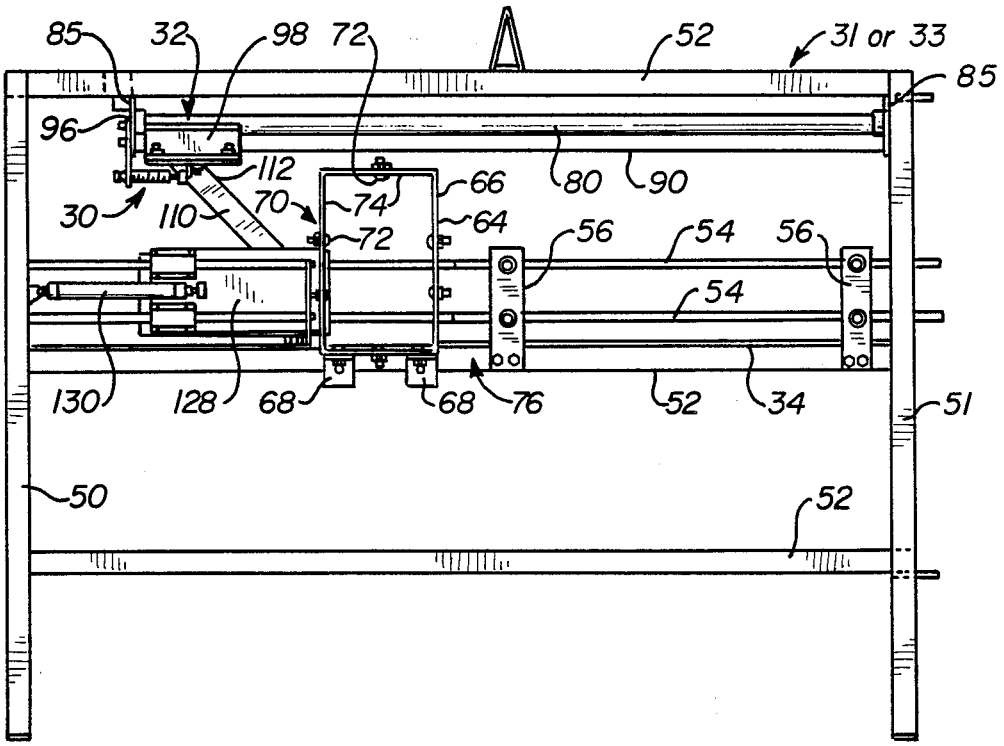
FIG. 2 is a side elevational view of a side table assembly of the bagger.
Figure 3:
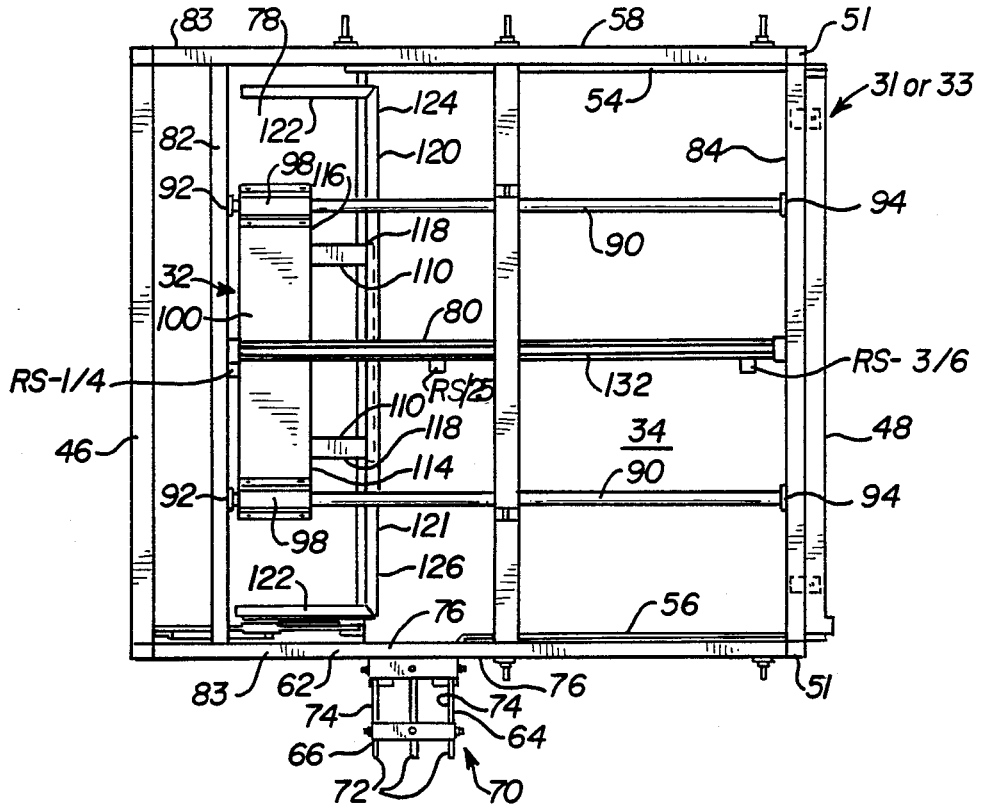
FIG. 3 is a plan view of the side assembly shown in FIG. 2.
Figure 4:
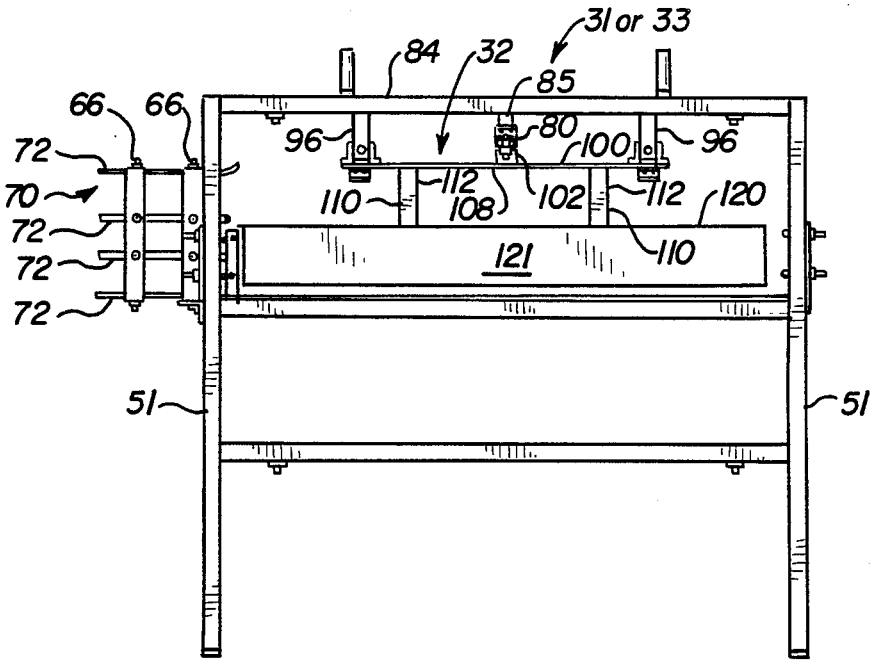
FIG. 4 is a downstream cross-sectional view of the side assembly shown in FIG. 2.

Referring to FIGS. 2–4, illustrating one of the identical side table assemblies 31, 33, the side push off plate 34 is rectangular and comprises upstream and downstream ends 46, 48. The plate 34 is supported by pairs of floor-engaging upstream and downstream vertical frame members 50, 51 and a pair of longitudinally-extending, central, horizontal frame members 52 rigidly secured to the vertical frame members 50, 51. The vertical frame members 50, 51 extend upwardly a predetermined distance above the plate 34 and are therefore in a position to support the side pusher assembly 32 above the same as will be hereinafter described in detail.

A plurality of rails 54, 56 positioned on opposite lateral sides 58, 62, respectively, of the plate 34 are mounted to the central horizontal frame members 52 by rail supports 56. The side rails 54, 56 function to prevent bottles 12 or 14 fed on the plate 34 from its respective conveyor from falling off the plate and also assist the bagger 10 in organizing the bottles into rows for subsequent movement onto the main table assembly 28. The rails 54 extend from the downstream end 48 of the plate 34 to a location approximately adjacent to a pusher paddle 120. The side rails 56 extend from the plate downstream end 48 upstream to a position where the respective conveyor is mounted to the plate 34.

To facilitate mounting of the respective conveyor 16 or 18 to the plate 34, the side table assembly is provided with a chute 70 at the longitudinal side 62 of the plate. The chute 70 comprises a framework of two collars 66 forming a rectangular perimeter around a plurality of rods 72 securely fastened to and between the interior surfaces 74 of the collars 66. Brackets 68 securely fasten the chute 70 to the central horizontal frame member 52 adjacent a central portion 76 of the plate 34.

The conveyor 16 or 18 functions to feed bottles 12 or 14 seriatim through the chute 70 and onto and transversely across an upstream portion 78 of the plate 34. The conveyor is of the type conventionally utilized in a variety of commercial and industrial environments to transport articles such as bottles from one stage of production or assembly to another. A conveyor which can be employed in operation of the invention is a conventional gravity feed conveyor.

Although the infeed conveyors 16, 18 of sides A, B are shown at the plate lateral sides 62 adjacent the upstream portion 24 of the main table assembly 28, the conveyors can be mounted to the lateral sides 58 of the plates 34 if the industrial environment so requires.

The side pusher assembly 32 of each side table assembly A or B comprises a drive cylinder 80 mounted to and between upstream and downstream upper horizontal frame members 82, 84 of the side table assembly. The upstream horizontal frame member 82 is secured to and between a pair of upper horizontal frame members 83. The downstream horizontal frame member 84 is secured to and between the pair of downstream vertical frame members 51. The drive cylinder 80 is secured to and between central portions 86, 88 of the upstream and downstream upper horizontal frame members 82, 84 by a pair of brackets 85 depending downwardly therefrom. In this manner, the drive cylinder 80 is supported above the side push off plate 34 and extends parallel to the longitudinal axis thereof. The drive cylinder 80 is preferably pneumatic and houses a piston (not shown) slidable along the full length of the drive cylinder 80. An example of a suitable drive cylinder is an Origa Cylinder Series 200 manufactured by Origa Corporation of Elmhurst, Ill.

The side pusher assembly 32 further includes a pair of guide shafts 90 securely mounted to and between the upstream and downstream horizontal frame members 82, 84 and spaced equidistantly opposite the drive cylinder 80. Upstream and downstream ends 92, 94 of each guide shaft 90 are secured to flange plates 96 mounted to and extending downwardly from the upstream and downstream horizontal frame members 82, 84. Ball bushings 98 slidably mounted to the guide shafts 90, 98 are securely connected together for synchronized slidable movement along the guide shafts 90 by a connecting plate 100. The piston (not shown) is securely connected to the connecting plate 100 by a bracket 102 secured to the piston. The bracket 102 is set in registry with an elongated channel (not shown) in the drive cylinder 80 and is movable relative thereto with the piston in the channel.

The side pusher assembly 32 also includes a pair of diagonal pusher frames 110 rigidly secured at upstream ends 112 thereof to opposite sides 114, 116 of the connecting plate 100. Downstream ends 118 of the pusher frames 110 are mounted to the pusher paddle 120 which is slidably supported on the push off plate 34.

In this manner, during operation of the pusher assembly 32, as the piston (now shown) moves along the length of and within the drive cylinder 80, the pusher paddle 120 slides along the plate 34 in synchronized movement with the piston.

The pusher paddle 120 is a substantially flat, U-shaped member positioned transverse of the plate 34. Legs 122 of the U-shaped paddle 120 extend a predetermined distance upstream of a bight portion 121 of the U-shape. The leg 122 adjacent the conveyor 16 or 18 functions to block movement of the bottles 12 or 14 onto the plate 34 during the above-described successive relatively short distance movements of the side pusher assembly 32. The legs 122 are provided on both ends 124, 126 of the paddle 120 to accommodate positioning of the conveyor 16 or 18 on either lateral side 58, 62 of the plate 34.

Each side table assembly further includes a stop gate 128 which functions to interfere with the feeding of bottles 12 or 14 onto the plate 34 when the paddle 120 is at the downstream end 48 of the plate, i.e., in those stages of the side pusher assembly 32 operation when the paddle leg 122 is unable to so block movement of bottles onto the plate. The stop gate 128 is movably mounted to the central horizontal frame member 53 at the lateral side of the plate to which the conveyor 16 or 18 is attached. Movement of the stop gate 128 is controlled by a stop gate cylinder 130 which drives the stop gate 128 in front of the chute 70 to interfere with the movement of bottles 12 or 14 onto the plate 34.

The side pusher assembly 32 for side A is further provided with three reed switches, RS-1, 2, 3 and the assembly for side B is provided with reed switches RS-4, 5, 6 as shown in FIG. 3. The switches RS-1 to -6 are mounted to walls 132 of their respective drive cylinders 80 at predetermined spaced intervals on the walls by fasteners (not shown). As will be hereinafter discussed, the reed switches function to detect the position of the pistons (not shown) relative to the drive cylinders 80 during operation of the pusher assemblies 32.

Figure 5:
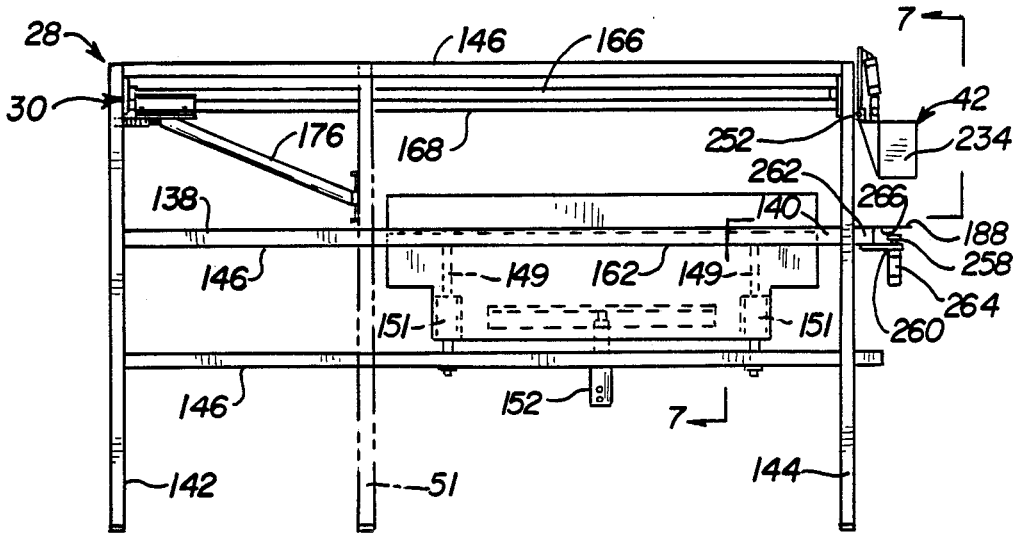
FIG. 5 is a side elevational view of a main table assembly of the bagger.
Figure 6:
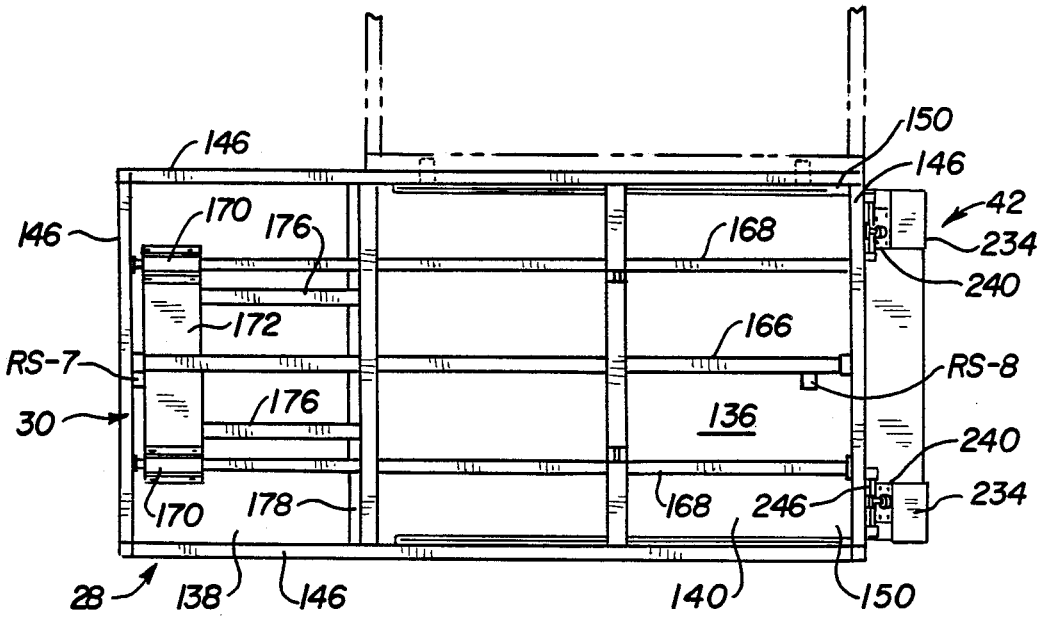
FIG. 6 is a plan view of the main table assembly shown in FIG. 5.
Figure 7:
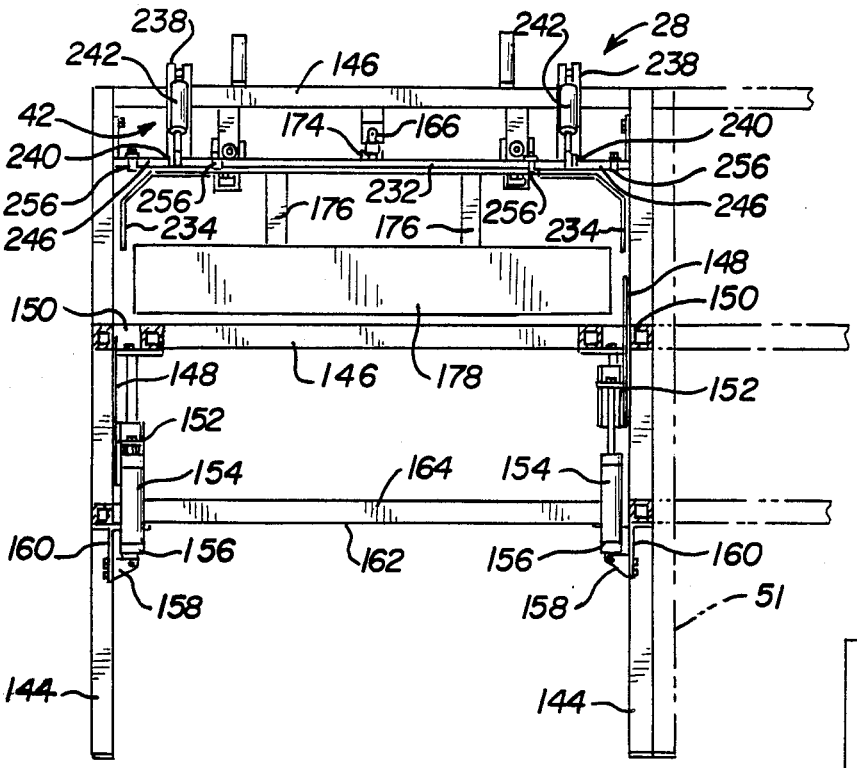
FIG. 7 is a cross-sectional view of the main table assembly of FIG. 5 taken along line 7—7.

As illustrated in FIGS. 5–7, the main table assembly 28 comprises a rectangular push off plate 136. The main plate 136 has upstream and downstream portions 138, 140 and is supported by pairs of floor-engaging upstream and downstream vertical frame members 142, 144 and a pair of central horizontal frame members 146 rigidly secured to the vertical frame members 142, 144 at opposite lateral sides 150 of the main plate 136. The upstream and downstream vertical frame members 142, 144 extend upwardly a predetermined distance above the main plate 136 and provide support for the main pusher assembly 30 hereinafter described in detail.

A vertically oriented, flat, bottle stop plate 148 is positioned at each lateral side 150 of the main plate 136. Each bottle stop plate 148 is mounted for vertical movement to a lower horizontal frame member 146 for movement between raised and lowered positions. A stop plate cylinder 154 actuates movement of each stop plate 148 between the raised and lowered positions. A bottom portion 156 of each cylinder 154 is securely mounted to a bracket 158 which is rigidly secured to an L-shaped flange 160 secured to a bottom surface 162 of the lower horizontal member 146. An upper portion of each cylinder 154 is mounted to a bracket 152 mounted to the stop plate 148. In the raised position, the stop plates 148 interfere with movement of bottles 12 or 14 from the side assemblies A, B onto the main plate 136. When the stop plates are lowered, the same are positioned below the main plate 136 and thus allow the side pusher assemblies 32 to move bottles onto the main plate 136. To guide the plates between their raised and lowered positions, the plates are slidably mounted on pairs of bars 149, by bearings 151, mounted to and between the central and lower horizontal frame members 146. It should be noted that the horizontal frame members function to restrict vertical movement of the stop plates 148 by interfering with upward and downward movement of the bearings 151.

The main pusher assembly 30 is similar in construction to the side pusher assemblies 32 and comprises a main drive cylinder 166 housing a main piston (now shown), main guide shafts 168, main ball bushings 170, a main connecting plate 172, a main connecting bracket 174, main pusher frames 176, a main pusher paddle 178, and reed switches RS-7, 8 which indicate fully retracted and extended positions, respectively, of the main pusher assembly.

Figure 8:
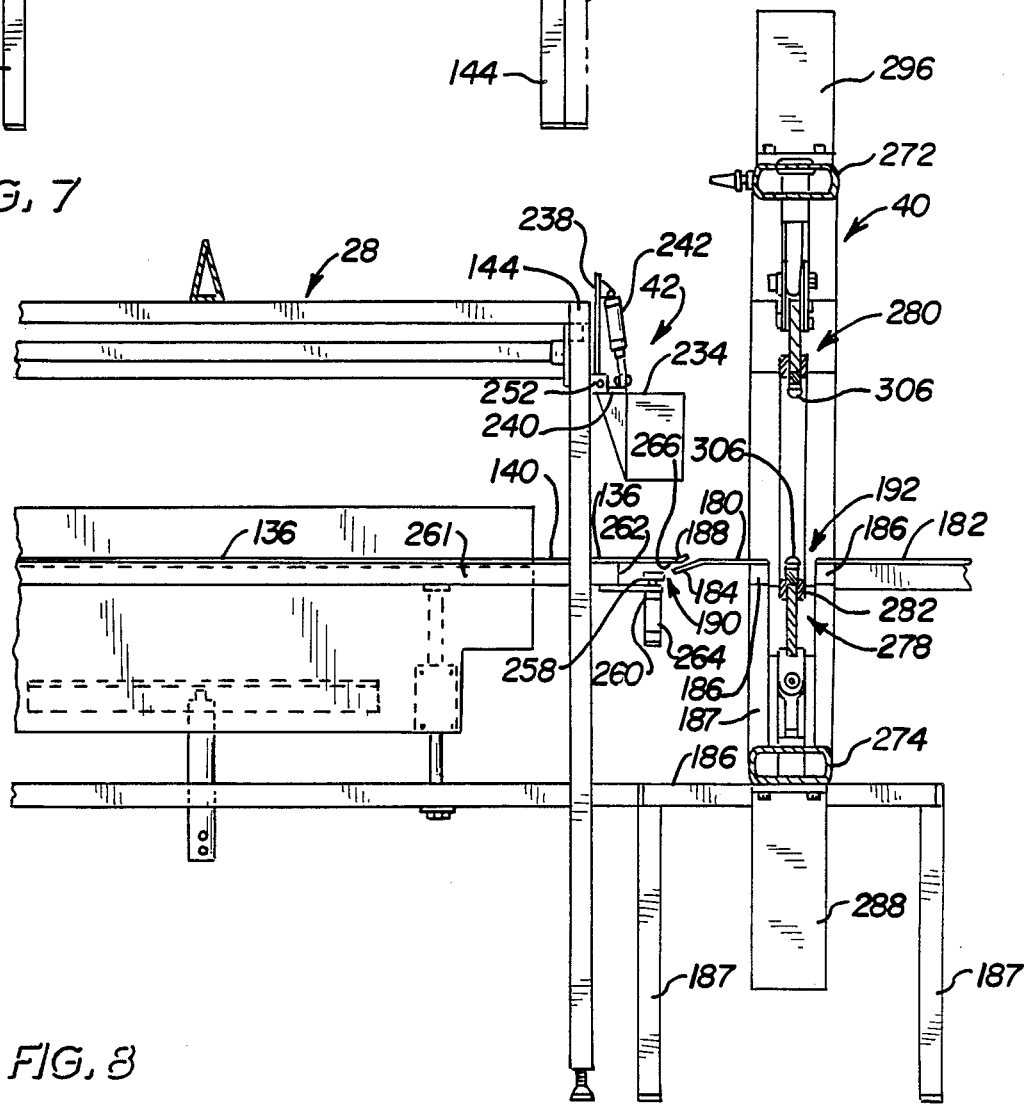
FIG. 8 is a fragmentary side elevational view showing bag holder and sealing assemblies of the bagger.

As shown in FIG. 8, downstream of the main table plate 136 are infeed and outfeed table plates 180, 182. The infeed table plate 180 is securely mounted to a horizontal frame member 186 and vertical frame members 187 and is positioned immediately downstream of and coextensive with the main plate 136. The infeed table plate 180 has a downwardly bent upstream edge 184. The edge 184 is set at an acute angle with respect to the horizontal and extends beneath an upturned downstream edge 188 of the main plate 136. The bent edge 184 forms an elongated slot 190 between the main and infeed plates 136, 180, with the slot 190 extending along the full length of the edge 188.

Figure 9:
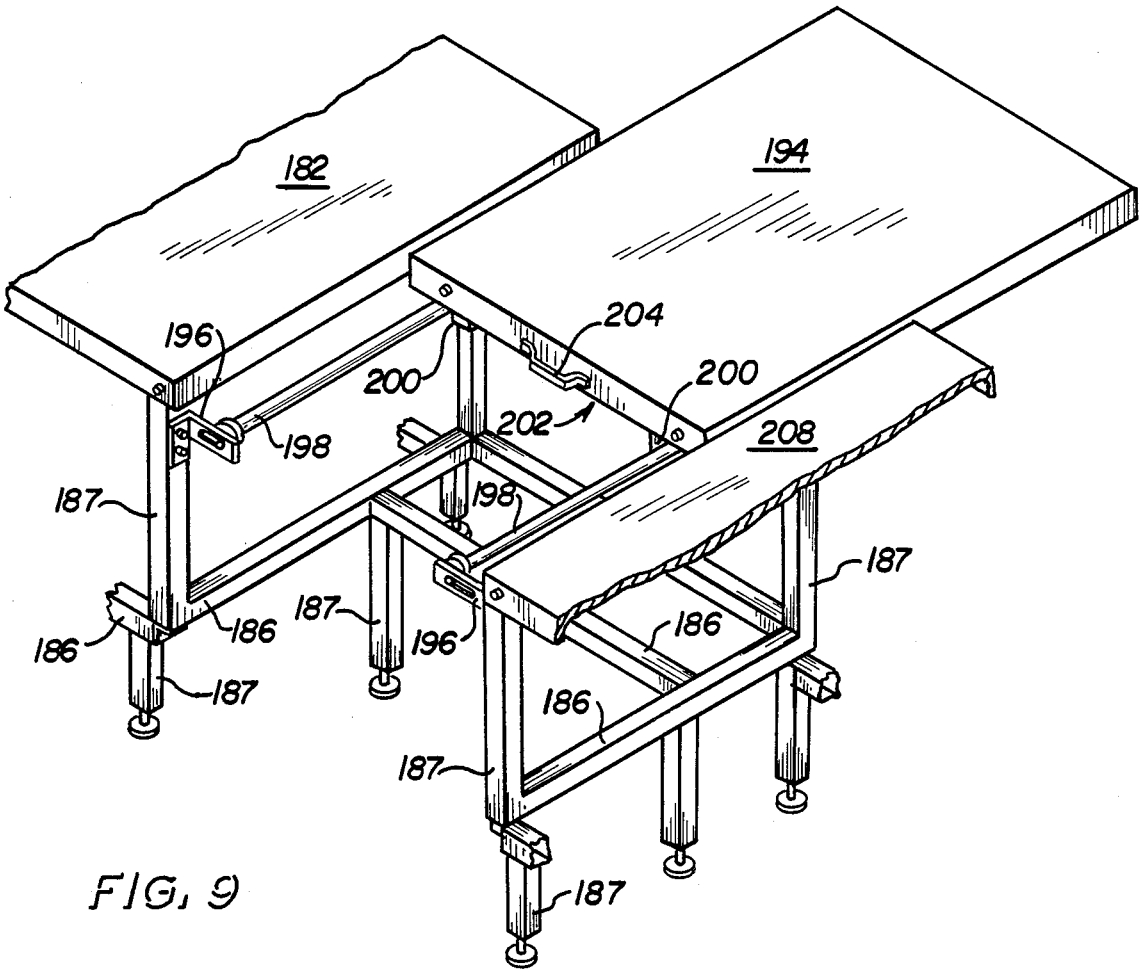
FIG. 9 is a fragmentary perspective view showing a sliding table of the bagger.

Referring now to both FIGS. 8 and 9, the outfeed table plate 182 is securely mounted to horizontal and vertical frame members 186, 187 which connect the outfeed table plate to the main table assembly 28 and a sliding table 194. The outfeed table plate 182 has same width as and is positioned in a spaced-apart relationship to the infeed table plate 180, thereby forming a space 192 between the infeed and outfeed table plates 180, 182. As explained in detail below, the sealing assembly 40 is positioned between the infeed and outfeed table plates 180, 182 and operates in the space 192.

The sliding table 194 is positioned directly downstream of and is coextensive with the outfeed table plate 182. In addition, the sliding table 194 is movably supported by horizontal and vertical frame members 186, 187, of the bagger 10 for lateral movement in a horizontal plane with respect to the outfeed table plate 182. Specifically, the sliding table 194 is movably mounted adjacent to the outfeed table plate 182 by two pairs of L-shaped brackets 196 rigidly secured to two pairs of vertical frame members 187 supporting the sliding table 194. Each pair of vertical frame members 187 is aligned transversely of the bagger 10. Two pairs of mounting rods 198 are securely mounted to and between each pair of transversely aligned L-shaped brackets 196. A pair of bearings 200 secured to a bottom surface 202 of the sliding table are slidably mounted to the mounting rods 198. In this manner, an operator can move the sliding table 194 laterally out of registry with the outfeed table plate 182 to permit the operator to position himself/herself adjacent to and directly downstream of the outfeed table plate 182 to perform specific tasks associated with operation of the bag holder assembly 42. To facilitate movement of the sliding table 194, a handle 204 is secured to each lateral side 206 of the sliding table 194. The operation of the sliding table 194 and the associated tasks incident to the bagging operation will be hereinafter explained in detail in connection with a discussion of the overall operation of the bagger 10.

Figure 10:
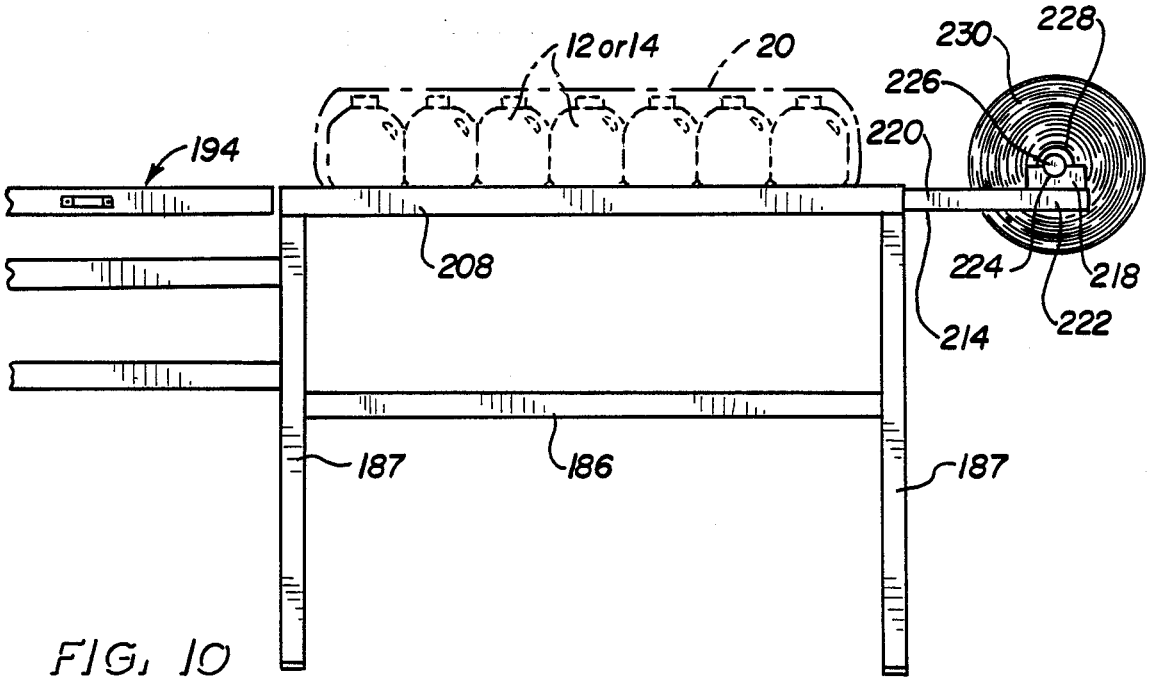
FIG. 10 is a fragmentary side elevational view showing a downstream table of the bagger.
Figure 11:
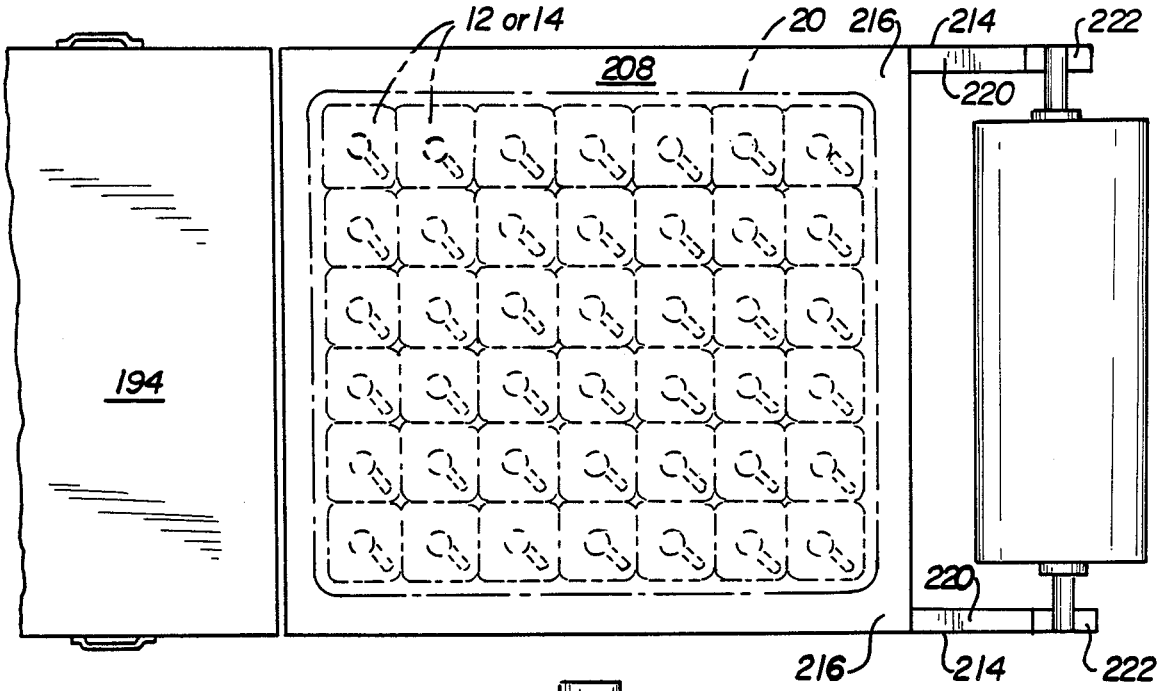
FIG. 11 is a fragmentary plan view of the downstream table of FIG. 10.

As illustrated in FIGS. 10 and 11, the bagger 10 further includes a downstream table 208 supported by horizontal and vertical frame members 186, 187 of the bagger. The downstream table 208 is positioned directly downstream of and is coextensive with the sliding table 194. The downstream table 208 has a pair of stanchions 214 rigidly secured to downstream corners 216 of the table 208. Support blocks 218 are securely attached to the stanchion upper surfaces 220 at the stanchion downstream edges 222. The support blocks 218 include sockets 224 in which a spool 226 is securely seated and rotatably supports a hollow roller 228 around which is wrapped a roll 230 of plastic bags 20.

Referring again to FIGS. 5–8, the bag holder assembly 42 is positioned above and below the downstream portion 140 of the main push off plate 136. The bag holder assembly 42 comprises a pair of buckets 234 and a pair of clamp feet 258. A rod-like horizontal support 232 is secured to and between the downstream vertical frame members 144 above the downstream portion 140 of the main push off plate 136. A pair of cylinder brackets 238 are securely mounted to the support 232 at opposite ends thereof. A pair of hinge links 240 are also mounted to opposite ends of the support 232 adjacent the cylinder brackets 238. Rotatably mounted to each hinge link is a rod 246 rotatable about pivot axis 252 through operation of a bucket cylinder 242 securely mounted to and between an upper portion of the cylinder bracket 238 and the hinge link 240. Ends of each mounting rod 246 are rotatably mounted to the horizontal support 232 through a pair of mounting flanges 256. The buckets 234 are securely mounted to the hinge links 240. In this manner, the buckets 234 are adapted to pivot vertically with rotation of the mounting rods 246 upon actuation of the bucket cylinders 242 and the resulting movement of the hinge links 240.

Each clamp foot 258 is movably mounted below the downstream edge 188 of the main push off plate 138 to a central horizontal frame member 146 to which the main push off plate downstream edge 188 is secured. Specifically, at each lateral side 150 of the push off plate 138, a clamp 260 is rigidly secured to the bottom surface 162 near the downstream edge 262 of the central horizontal frame member 146. A clamp cylinder 264 is mounted to each clamp 260, and the clamp foot 258 is mounted to the cylinder 264 and is positioned directly underneath the push off plate 138. Each clamp foot 258 is adapted for movement into and out of secure engagement with a bottom surface 266 of the main push off plate 138 by actuation of the clamp cylinder 264.

As will be hereinafter explained in detail, the buckets 234 and the clamp feet 258 function to hold a bag 20 in an open position so that the central pusher paddle 178 can force accumulated rows of bottles 12 or 14 from the main push off plate 138 and into the bag 20 positioned on the sliding and downstream tables 194, 208.

Figure 12:
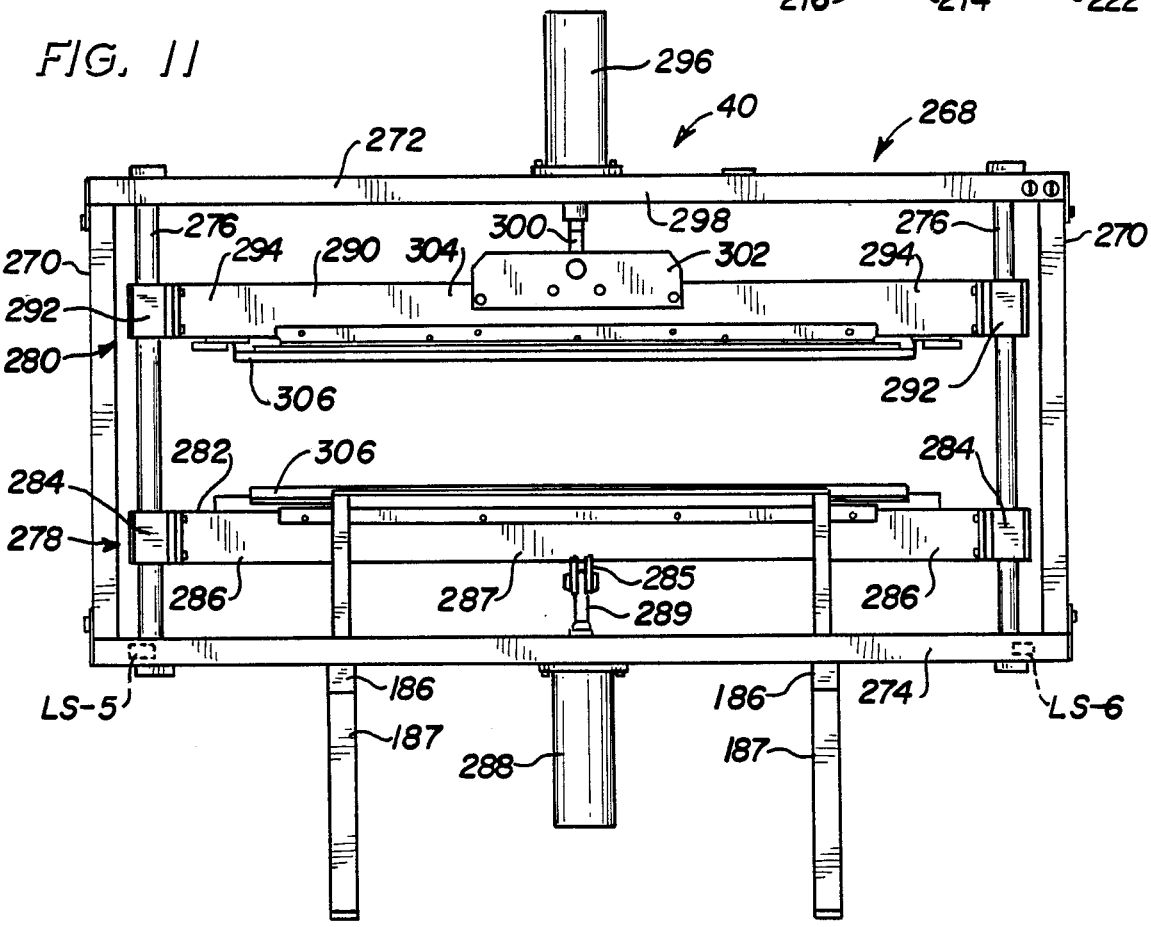
FIG. 12 is a downstream cross-sectional view of the sealing assembly shown in FIG. 8.

As shown most clearly in FIGS. 8 and 12, the sealing assembly 40 is positioned in the space 192 between the infeed and outfeed table plates 180, 182 and includes a rectangular sealing jaw frame 268 formed of a pair of vertical frames 270 and upper and lower horizontal frames 272, 274. The lower horizontal frame 274 is mounted to the vertical and horizontal frame members 186, 187. A pair of poles 276 are mounted to the upper and lower horizontal frame members 272, 274 at the outer ends thereof.

The sealing assembly 40 further includes a lower sealing jaw assembly 278 and an upper sealing jaw assembly 280. The lower sealing jaw assembly 278 includes a lower sealing jaw 282 slidably mounted at opposite ends 286 thereof to the poles 276 by a pair of bearings 284. The lower sealing jaw 282 is movable between an "open" position approximately even with the infeed and outfeed table plates 180, 182 as illustrated in FIG. 8, and a "closed" or "clamping" position above the plates and in contact with the upper sealing jaw assembly 280. The lower sealing jaw 282 is driven by a lower sealing jaw cylinder 288 secured to the lower horizontal frame 274 and mounted to the lower sealing jaw by a clevis 285 at a central portion 287 of the lower sealing jaw 282. A piston-driven arm 289 of the cylinder 288 extends through an opening in the lower horizontal frame 274 and is mounted to the clevis 286.

The upper sealing jaw assembly 280 comprises an upper sealing jaw 290 slidably mounted to and between the poles 276 by a pair of bearings 292 at outer portions 294 of the jaw. The upper sealing jaw 290 is adapted to move vertically from an "open" position illustrated in FIGS. 8 and 12 and a "closed" or "clamping" position in contact with the lower sealing jaw 282. The upper sealing jaw is driven by an upper sealing jaw cylinder 296 secured to a central portion 298 of the upper horizontal frame 272. The upper sealing jaw cylinder 296 includes a piston-driven arm 300 extending through an opening in the upper horizontal frame 272 and mounted to a bracket 302 secured to a central portion 304 of the upper sealing jaw 290. The upper and lower sealing jaws 282, 290 include oppositely positioned sealing jaw bars 306. The bars 306 are preferably made of machined aluminum.

The sealing assembly 40 functions to seal a bag 20 at the open end thereof and at the same time to sever excess material of the bag 20 upstream of the seal after the bag 20 has been filled with accumulated rows of bottles 12 or 14. To this end, the sealing assembly 40 includes a heater element (not shown) comprising a thin metal band mounted to the surface of one of the sealing jaw bars 306. A cold wire (not shown) is mounted to the surface of the other sealing jaw bar 306. Teflon strips (not shown) are secured to the bars 306 to insulate the band and the cold wire from the aluminum bars 306. When the upper and lower sealing jaws 282, 290 move from the open position to the closed or clamping position, the open end of the bag 20 is closed and held firmly in place by the sealing jaw bars 282, 290. A thermal impulse is then produced in the heater element. The heat produced functions to seal the open end of the bag 20. The cold wire against the heater element severs excess material from the bag portion upstream of the seal. Suitable sealing jaw bars 306 are manufactured by Vertrod, Inc., of Brooklyn, N.Y.

As a safety feature, the upper and lower sealing jaw cylinders 296, 288 first drive the upper and lower sealing jaws 280, 282 from the open to the clamping positions under low pressure, approximately 20 p.s.i. Under such force, the upper and lower jaws 280, 282 will not cause injury to an operator who inadvertently causes an obstruction, such as his/her arm, to be positioned between the jaws during operation of the sealing jaw assembly 40. Once the sealing jaw bars 306 are set in closed engagement, and only after a manually actuated signal from the operator, the clamping pressure is increased to approximately 80 p.s.i. and an electric current is applied to the heater element to thereby seal and sever the plastic bag 20. This safety feature will be hereinafter discussed in detail in connection with an explanation of the operation of the bagger.

The dual accumulating bagger 10 is fitted with guard covers (not shown) surrounding the bagger side and main assemblies 31, 33, 28. The covers function as a safety feature as well as prevent dust from accumulating on the bagger. A plurality of doors (not shown) are pivotably mounted to the covers and permit access to elements of the bagger 10. Limit switches LS-7 to 12 (not shown) positioned adjacent to the doors cause the bagger to be inoperative when the doors are open and the switches are activated. Limit switches LS-9 and 10 are associated with the doors at side A of the bagger 10. Switches LS-11 and 12 are mounted at the doors at side B. LS-9 and 10 and LS-11 and 12 operate independently so that when one side of the bagger becomes inoperative due to activation of the switches LS-9 and 10 or LS-11 and 12, the other side remains operative.

Figure 13:
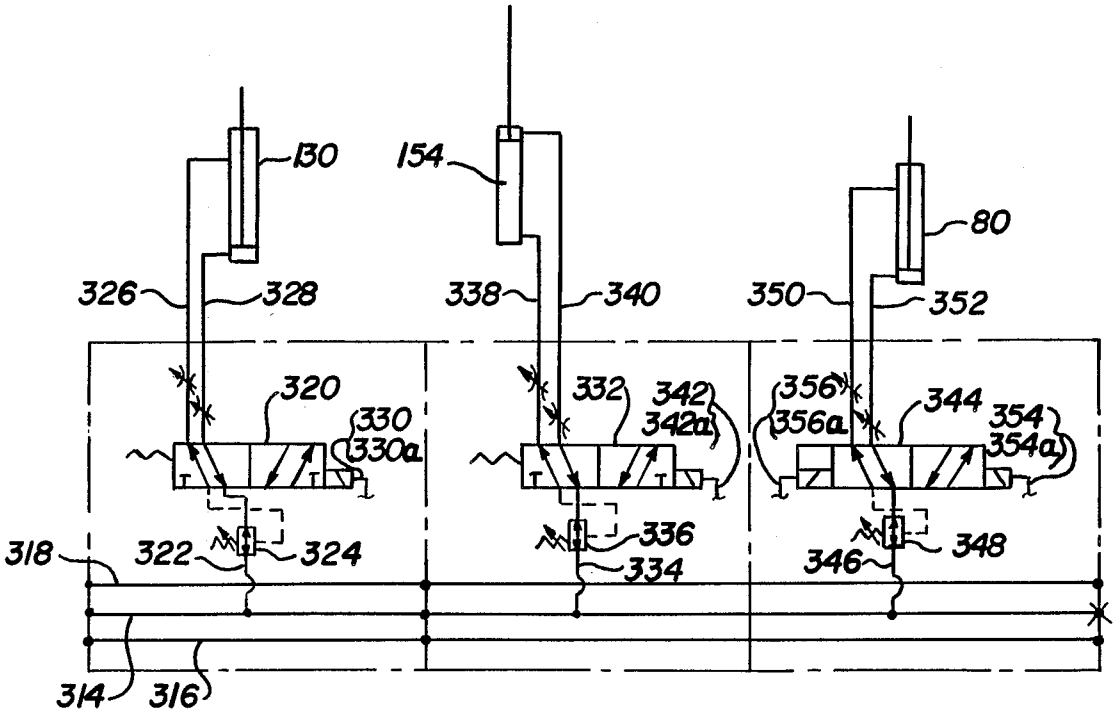
FIG. 13 is a schematic representation of a hydraulic control system for the side table assembly.
Figure 14:
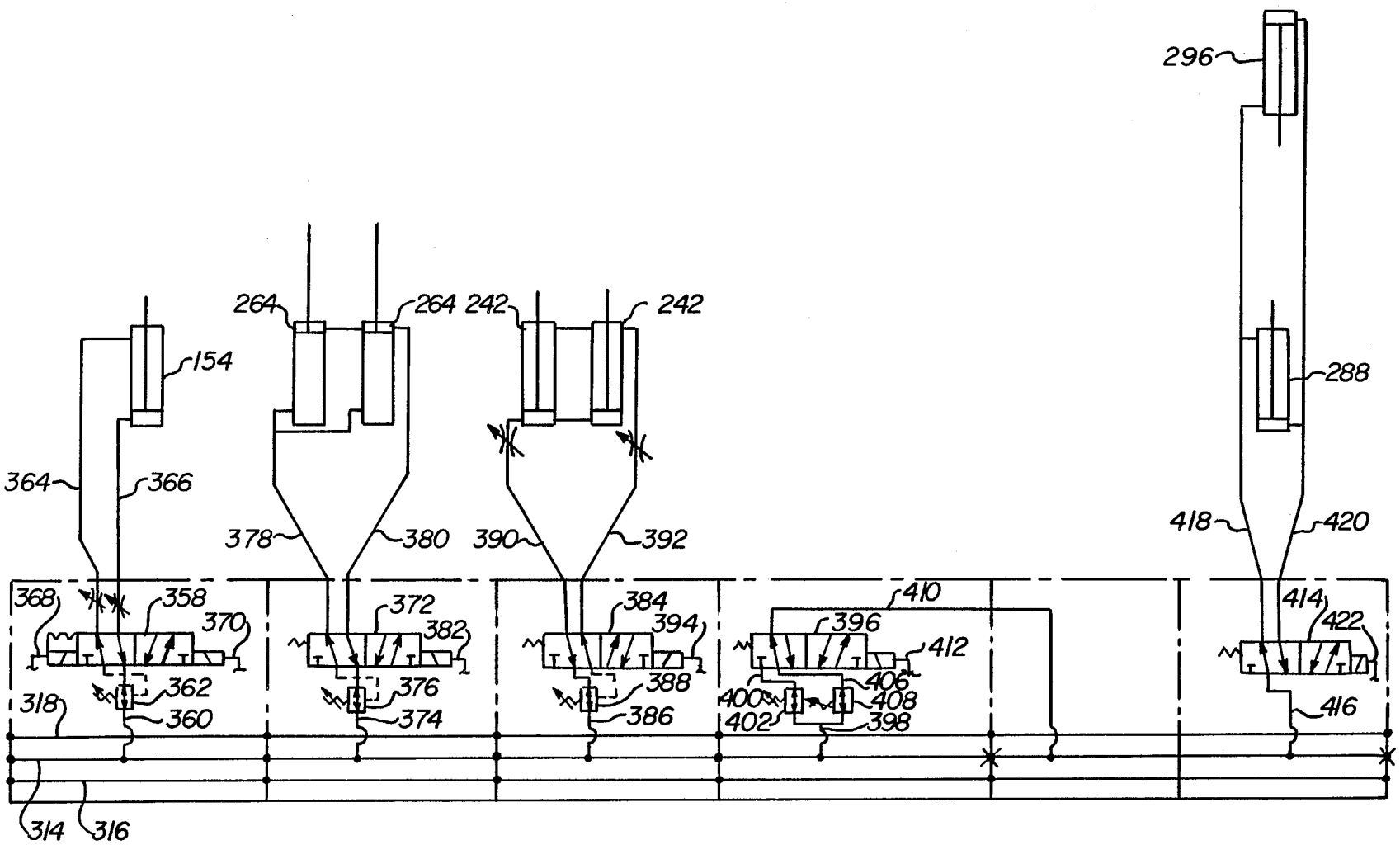
FIG. 14 is a schematic representation of a hydraulic control system for the main table, bag holder, and sealing assemblies.
Figure 15:
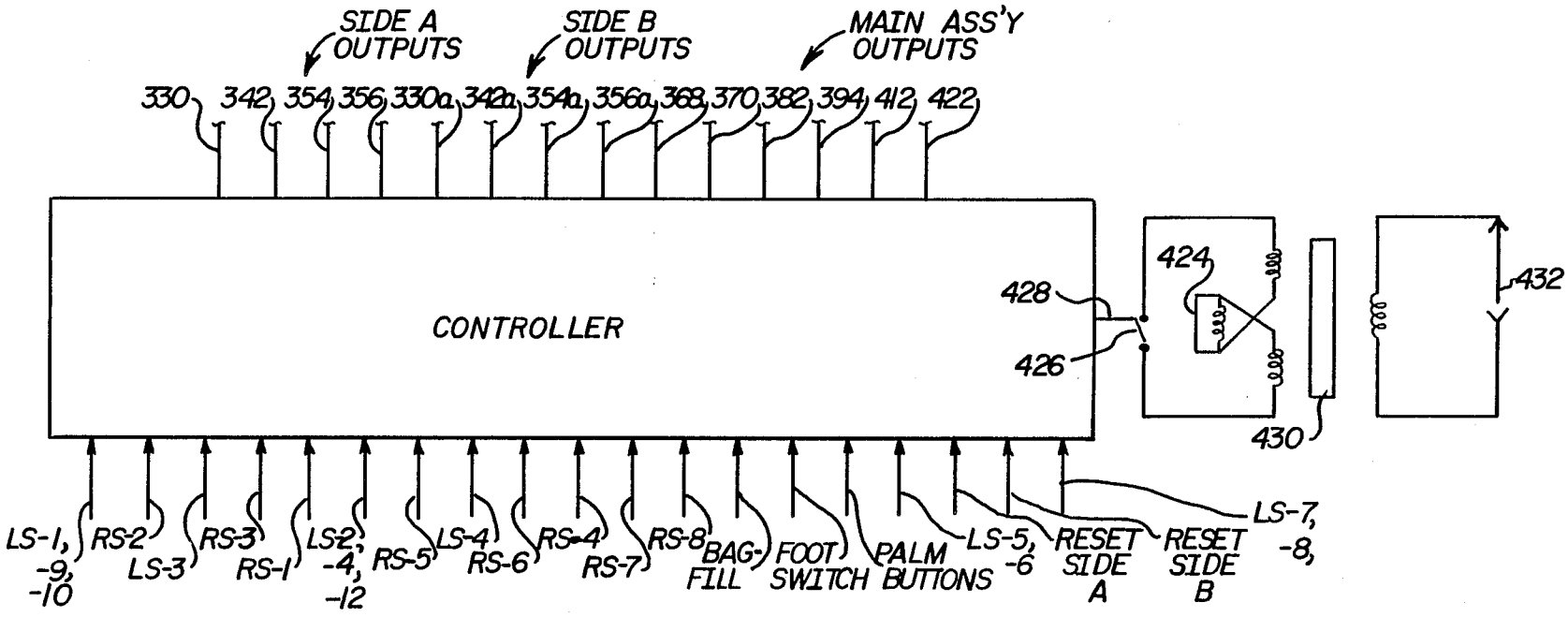
FIG. 15 is a schematic representation of an electronic controller employed in the operation of the bagger.

Referring to FIGS. 13–15, there is shown a schematic of a control system used to operate the bagger 10 and comprising a fluid pressure line 314 connected to a source of fluid pressure and exhaust lines 316 and 318 connected to atmosphere. The fluid pressure source preferably is a source of pressurized air.

A plurality of solenoids operate a number of spool valves which in turn actuate the various cylinders of the side and main table assemblies. Because operations of the side assemblies are similar, the following description relates to only one side assembly.

As illustrated in FIG. 13, the side assembly A or B has three spool valves 320, 332, 344 each operated by a separate solenoid. With respect to operation of the bottle stop gate 128, a solenoid-operated spool valve 320 is connected to the fluid pressure line 314 through an inlet line 322 and a regulator valve 324. An outlet line 326 having a flow control valve is connected between the valve 320 and one end of the side bottle stop cylinder 130. Another outlet line 328, also having a flow control valve, is connected between the valve 320 and the other end of the first cylinder 130. An electrical control line 330 operates the solenoid of the solenoid-operated spool valve 320 to shift the valve between two operative positions. In one position, pressurized fluid is directed from the inlet line 322 to the outlet line 326 to drive the push rod of the cylinder 130 in one direction, while at the same time the outlet line 328 is connected to exhaust line 318. Alternatively, when the valve is switched to the other operative position, the inlet line 322 is connected to the outlet line 328 to drive the push rod in an opposite direction, and the outlet line 326 is connected to exhaust line 316.

With respect to operation of stop plate 148, a second solenoid-operated spool valve 332 is connected to the fluid pressure line 314 through an inlet line 334 and regulator valve 336. An outlet line 338 and an outlet line 340 are connected alternatively to opposite ends of the bottle stop plate cylinder 154. Both outlet lines 338, 340 have flow control valves and are alternatively connected to the exhaust lines 316, 318, respectively. An electrical-control line 342 operates the solenoid of the solenoid-operated spool valve 332 to shift the valve between two operative positions. In one position, pressurized fluid is directed from the inlet line 334 to the outlet line 338 to drive the push rod of the bottle stop plate cylinder 154 in one direction, while at the same time the outlet line 340 is connected to exhaust line 318. Alternatively, when the valve is switched to the other operative position, the inlet line 334 is connected to the outlet line 340 to drive the push rod in an opposite direction, and the outlet line 338 is connected to exhaust line 316.

With respect to operation of the side pusher assembly 32, a third solenoid-operated spool valve 344 is connected to the fluid pressure line 314 through an inlet line 346 and regulator valve 348. An outlet line 350 and an outlet line 352 are connected alternatively to opposite ends of the side pusher drive cylinder 80. Both outlet lines 350, 352 have flow control valves and are alternatively connected to the exhaust lines 316, 318, respectively. An electrical control line 354 controls the movement of the valve in one direction and an electrical control line 356 controls the movement of the spool valve in an opposite direction. The operation of the spool valve 344 is the same as the operation of spool valve 320 except that the spool valve 344 is driven in opposite directions by solenoids at either end of the spool valve in spool valve 344, whereas in valve 320 a single solenoid drives the spool valve in one direction and a spring biases the spool valve in an opposite direction.

As illustrated in FIG. 14, the main assembly 28 contains five solenoid-operated spool valves. With respect to the operation of the main pusher assembly 30, the first spool valve 358 is connected to the fluid pressure line 314 through an inlet line 360 and regulator valve 362. An outlet line 364 and an outlet line 366 are connected alternatively to opposite ends of the main pusher drive cylinder 166. Both outlet lines 364, 366 have flow control valves and are alternatively connected to the exhaust lines 316, 318, respectively. An electrical control line 368 controls the movement of the valve 358 in one direction and an electrical control line 370 controls the movement of the valve 358 in an opposite direction. The operation of the spool valve 358 is the same as the operation of the side pusher cylinder spool valve 344.

With respect to operation of the clamp feet 258 of the bag holder assembly 42, a second main assembly solenoid-operated spool valve 372 is connected to the fluid pressure line 314 through an inlet line 374 and a regulator valve 376. An outlet line 378 and an outlet line 380 are connected alternatively to opposite ends of the clamp feet cylinders 264, depending on the position of the spool valve 372. Also, the outlet lines 378, 380 are connected to either the exhaust line 316 or the exhaust line 318, respectively. An electrical control line 382 controls the operation of the solenoid in the spool valve 372. The operation of the solenoid-operated spool valve 372 is the same as the operation of the spool valve 320.

With respect to operation of the buckets 234 of the bag holder assembly 42, a third main assembly solenoid-operated spool valve 384 is connected to a fluid pressure line 314 through an inlet line 386 and a regulator valve 388. Outlet lines 390, 392 are connected to opposite ends of the bucket cylinders 242 and selected outlets from the spool valve 384. The outlet lines 390 and 392 are likewise connected alternatively to the exhaust line 316 and the exhaust line 318, respectively. The position of the spool in the spool valve 384 is controlled by a solenoid which is energized through an electrical control line 394.

With respect to operation of the sealing jaw assembly 40, a fourth main assembly solenoid-operated spool valve 396 is connected to the fluid pressure line 314 through an inlet line 398, a first branch line 400 and regulator valve 402 and a second branch line 406 and regulator valve 408. An outlet line 410 is connected to the valve to receive pressure from either the second branch line 406 or a combination of the first branch line 400 and the second branch line 406. The position of the spool in the spool valve 396 is controlled by a solenoid energized through an electrical-control line 412. The solenoid-operated spool valve 396 operates to supply fluid pressure to line 410 at two different pressure levels, depending on the position of a spool in the spool valve 396. Spool valve 396 works in conjunction with a valve 412 to control the sealing jaw cylinders 288, 296.

A fifth main assembly solenoid-operated spool valve 414 is connected to the incoming fluid pressure line 410 through an inlet line 416. An outlet line 418 is connected to one end of the sealing jaw assembly cylinders 288, 296 and an outlet line 420 is connected to another end of the cylinders 288, 296. The outlet lines 418 and 420 are connected either to the inlet line 416 through the spool valve 414 or to an exhaust line 316, 318. The outlet line 418 connects to the exhaust line 316 and the outlet line 420 connects to the exhaust line 318. An electrical control line 422 controls the solenoid in the spool valve 414.

Coordinated movement of the main and side assemblies, and the bag holder and sealing jaw assemblies is actuated by a controller 312. Specifically, the controller 312, illustrated schematically in FIG. 15, controls the spool valves for the two side assemblies and the main assembly. The controller 312 can be a hard wire control mechanism or a programmable controller as understood by those having skill in the program control art. Further, the controller 312 controls the energization of the wires 424 of the heater element (not shown).

The controller 312 receives inputs from the limit and reed switches and sends outputs to the solenoids of the side and main assemblies. In addition, the controller has inputs for a bag-fill switch, a foot switch and palm and reset buttons. In addition, the controller 312 has outputs 428 for the wires 424 of the heater element (not shown).

The wire output 428 is connected to a switch 426 in an electrical circuit with the wires 424 and transformer 430. A voltage source 432 supplies power to a primary coil (not shown) of the transformer 430. Upon closing of the switch 426, the transformer will generate current in the wires 424 in the wire circuit.

Operation of the bagger 10 will now be described with reference to all of the Figures. With respect to operation of the controller 312, reference should be made specifically to FIGS. 13–15.

As stated above, the bagger 10 functions to alternatively fill bags 20 with accumulated rows of bottles 12, 14 of different size. Thus, bottles 12 fed onto side A can be of a different size than bottles 14 fed onto side B. However, each bag 20 is preferably filled with only one type of bottle 12 or 14. The controller 312 is pre-programmed for alternately moving accumulated rows from the different sides A and B. For example, bags 20 may be filled at a rate of one bag of side A bottles, then one bag of side B bottles, or a plurality of side A bags may be filled before a side B bag of bottles; or one bag of bottles from side A may be filled, followed by a plurality of bags of side B bottles. In the following example, there is described a sequence of alternating from side A to side B, wherein one bag is filled from side A and then another bag is filled from side B.

To fill the first bag 20 with a plurality of rows of bottles 12 from side A, and thereafter to seal the bag, the operator first positions the bag 20 on the bag holder assembly 42 by unrolling and removing the bag 20 from the roll 230 and placing the bag on the downstream table 208 with the open of the bag positioned upstream. The operator then moves the sliding table 194 laterally to allow the operator to position himself/ herself directly downstream of the outfeed table plate 182.

Next, the operator presses the foot switch (not shown) which provides an input to the controller 312 as shown in FIG. 15. The controller 312 will then generate output signals to drive spool valves 372, 384, respectively, so that the push rods of the clamp feet cylinders 264 will be retracted, thereby dropping the clamp feet 258; and the push rods of the bucket cylinders 242 will be extended, thereby pivoting the buckets 234 downwardly.

While maintaining pressure on the foot switch, the operator then feeds the lower portion of the open end of the bag 20 through the slot 190 between the main push off plate 136 and the infeed table plate 180. He/she then positions the lower portion of the bag between the push off plate bottom surface 266 and the clamp feet 258. The operator then releases the foot switch which causes the controller 312 to immediately send a signal to the solenoid of the spool valve 372 to shift the spool valve to the opposite position to drive the push rods of the clamp feet cylinders 264 upwardly, thereby raising the clamp feet 258 and consequently sandwiching and holding the lower portion of the open end of the bag 20 between the bottom surface 266 of the main push off plate 136 and the clamp feet 258.

While remaining substantially downstream of the outfeed table plate 182, the operator then places the upper portion of the bag 20 over the buckets 234.

In the event that salvage from a previous bag remains positioned on the buckets 234 and beneath the main push off plate 136, the salvage must first be removed before a new bag 20 is positioned on the buckets 234 and beneath the push off plate 136.

After a predetermined time period, the controller 312 sends a signal to the solenoid of the spool valve 384 to retract the push rods of the bucket cylinders 242 to raise the buckets 234. In this manner, the open end of the bag 20 is held wide open between the push off plate bottom surface 266 and the buckets 234.

Subsequently, the operator slides the sliding table 194 back to the position aligned directly downstream of the outfeed table plate 180. In this manner, the open end of the bag 20 is held wide open by the clamp feet 258 and the buckets 234 and is thus able to receive rows of bottles 12 or 14 that are moved from the main push off plate 136 to within the bag by the main pusher assembly 30.

In operation of each side pusher assembly 32, (in this instance, side A) the piston (not shown) is set in its most upstream position adjacent to reed switch RS-1 and the pusher paddle 120, connected to the piston by the pusher frames 110, is set slightly upstream of the infeed conveyor 16. When the piston and the pusher paddle 120 are so positioned, the conveyor 16 feeds bottles 12 seriatim onto the push off plate 34. The bottles 12 are forced in single file transversely across the push off plate 34 by each succeeding bottle fed onto the plate 34. When the first bottle 12 that is fed onto the push off plate 34 (hereinafter, the "leading bottle") reaches the lateral side 58 of the plate opposite the conveyor 16, the leading bottle will contact first limit switch LS-1. LS-1 provides an input to the controller 312 which pulses the solenoid for spool valve 344 to drive the push rod of the drive cylinder 80 and the pusher paddle 120 downstream until the piston (not shown) reaches a position in the drive cylinder adjacent reed switch RS-2. RS-2 then signals the controller 312 to pulse the spool valve 344 to thereby cause the piston (not shown) to stop and retract to a position adjacent RS-1. By this operation, the pusher paddle 120 forces a first row of bottles 12 downstream a predetermined distance, preferably approximately six inches. This distance is sufficient to enable another row of bottles 12 to be fed onto the infeed table by the conveyor 16 directly upstream of the first row.

When the piston is positioned adjacent RS-2, a leg 122 of the paddle 120 is positioned directly in front of the infeed conveyor 16 and prevents further feeding of bottles therefrom onto the push off plate 34. If bottles were allowed to be fed onto the plate 34 at this time, they would be loaded upstream of the paddle 120. In this position, the bottles 12 would not be in a position to be moved downstream by the pusher paddle 120 for eventual loading into the bag 20. When the piston retracts, the leg 122 moves upstream and out of interference with the movement of bottles 12 onto the push off plate 34.

When another row of bottles 12 is allowed to accumulate on the side push off plate 34, the leading bottle of the second row contacts LS-1, which again signals the controller to move the piston, the pusher paddle 120 and the second row of bottles 12 downstream and then retract the piston to a position adjacent RS-1. This process is repeated a predetermined number of cycles until a predetermined number of rows of bottles 12 are positioned on the side push off plate 34. Each time the piston slides between RS-1 and RS-2, a pulse is applied to the controller. After a predetermined number of pulses or counts, the controller signals the solenoid for spool valve 344 to cause the piston to stop and retract to a position adjacent RS-1 and to subsequently signal the paddle 120 to move the accumulated rows onto the main table plate 136.

When the controller 312 indicates that it is appropriate for bottles 12 to be moved onto the main table assembly 28, the controller 312 signals the appropriate bottle stop plate 148 to be lowered so the top of the plate 148 is approximately flush with the main push off plate 136. The controller 312 then pulses the solenoids for spool valve 332 to drive the side pusher piston and pusher paddle 120 across the push off plate 34 until the piston is positioned in the drive cylinder 80 adjacent reed switch RS-3. Thereafter, downstream (i.e., toward the main table assembly 28) movement of the piston stops and the piston retracts to the position adjacent RS-1. In this manner, the rows of bottles 12 are moved across the side tables A and onto the main push off plate 136. After the side pusher piston retracts, the bottle stop plate 148 is moved to the raised position.

When the side pusher paddle 120 is moved to the downstream end 48 of the side push off plate 34, the leg 122 of the paddle is not in a position to prevent movement of bottles 12 onto the side push off plate 34. At this time, the controller 312 actuates the bottle stop gate cylinder 130 to move the stop gate 128 in front of the conveyor 16 to prevent further movement of bottles 12 onto the plate 34. Specifically, the controller 312 pulses the solenoid in spool valve 320 to cause the push rod of the cylinder 130 to retract to thereby move the stop gate 128 into a blocking position. In addition, when the piston (not shown) is moved back to the position adjacent RS-1, rows of bottles 12 are then allowed to accumulate on the push off plate 34 in the identical manner as described above.

After the bottles 12 are positioned on the main table assembly 28, they are ready to be moved into a plastic bag 20. However, at this time, the operator may not have finished placing the bag 20 on the bag holder assembly 42. When the operator has completed this task, he/she presses the bag-fill switch (not shown) which signals the controller 312 to pulse the solenoids for spool valves 358, 372 to drive the main pusher piston (not shown) and the main pusher paddle 178 downstream until the piston is positioned in the drive cylinder 166 adjacent to reed switch RS-8. Thereafter, downstream movement of the piston stops, and the piston retracts to the position adjacent to RS-7. In this manner, the accumulated rows of bottles 12 are moved across the infeed table plate 180, between the upper and lower sealing jaws 290, 282 and into the open end of the bag 20 positioned on the bag holder assembly 42.

When the main pusher piston (now shown) is retracted from its downstream position adjacent RS-8 to the position adjacent RS-7, the operator pushes the two palm buttons (not shown) which signal the controller 312 to operate the upper and lower sealing jaw cylinders 296, 288. This drives the upper and lower sealing jaws 290, 282 together to seal the open end of the bag 20 and sever excess material of the bag upstream of the seal. Specifically, after the palm buttons are pushed the controller 312 sends a signal to the spool valve 396 to drive the valve so that the line 410 receives pressure only from the branch line 406. At the same time, the controller 312 pulses the solenoid for valve 414 to move the spool so that the input line 416 is connected to the output line to drive the sealing jaws 282, 290 together. Initially, a relatively low pressure, approximately 20 p.s.i., is applied to drive the sealing jaws 282, 290 together. Therefore, in the event that an operator's arm is positioned between the jaws, little or no injury will be sustained by the operator. After the jaws come together, the controller 312 pulses the solenoid for the spool valve 292 to shift so that the outlet line 410 receives the pressure from both the first branch 400 and the second branch 406, thereby applying greater pressure, approximately 80 p.s.i., to the cylinders 288, 296. The sealing jaws 282, 290 are thus tightly clamped together. At this time, the controller 312 pulses the wires 426 and 428 shown in FIG. 15 to seal and sever the bag 20.

When the sealing jaws 282, 290 are brought together, LS-5 and LS-6 are actuated, thereby sending a signal to the controller 312. The controller 312 has a timing system which performs a timing function which is started when the palm buttons are pushed. In order for the controller 312 to activate the wire outputs 426 and 428, the controller must receive input signals from LS-5 and LS-6 before the timer times out. If the timer times out before an input signal from LS-5 and LS-6 (before the jaws close), the controller 312 will send a signal to shift the spool in the spool valve 414 to retract the sealing jaw cylinders 288, 296. Thus, the sealing jaws 282, 290 open automatically in the event that LS-5 and LS-6 are not activated within a pre-determined period of time after the jaws begin to close. This feature prevents the jaws from clamping on an operator for an extended period of time and provides an automatic release in the event that an obstruction is positioned between the clamping jaws. In addition, the electrical current for the wires 424 is not actuated in the event that the jaws do not meet and LS-5 and LS-6 are not actuated.

After the preset number of bags 20 have been filled with bottles 12 from the side A assembly 31, the controller 312 will switch to filling bags 20 of bottles 14 from the side B assembly 33. Bottles 14 may be of a different size than bottles 12, thereby permitting the bagger assembly 10 to alternate bagging bottles of different sizes. After the preset number of bottles 14 from the side B assembly 33 have been bagged, the controller will switch back to filling bags 20 of bottles 12 from the side A assembly 31.

Another safety feature of the bagger assembly 10 is found with the covers (not shown) which surround the machine. The covers are made of a material such as translucent plastic and prevent access to the main and side assemblies 28, 31, 33 during operation. Access doors (not shown) give the operator access to the components However, the machine will not operate if the door to the main pusher assembly 30 is not closed. The side A and B assemblies 31, 33 can be operated only if their respective doors are in the closed position. For example, if the access door to side A 31 is closed, but the door to side B 33 is open, then only the pusher assembly 32 on side A will operate. Limit switches LS-7 to 12 control this safety feature.

A bag-fill input switch (not shown) is provided when the operation is to be started. This input is provided to the controller 312 as shown in FIG. 15.

Finally, if for some reason the counter (not shown) is out of sequence with the number of rows of bottles which have been pushed on the side push off plates 34 between RS-1 and RS-2 or RS-4 and RS-5, the operator can reset the counter for each side assembly 31, 33 and start the cycle anew by pressing side A or side B reset buttons (not shown). The reset button signals the controller as shown in FIG. 15 to reset the counter.

While the invention has been described in connection with the preferred embodiment, it will he understood that I do not intend to limit the invention to that embodiment. To the contrary, I intend to cover all alternative modifications and equivalents as may be included within the spirit and scope of the invention as defined by the appended claims.

I claim:

1. An apparatus for packaging articles, said apparatus comprising upstream and downstream portions, table means, conveyor means, and control means;

said table means being adapted to support said articles and comprising a center table and a pair of side tables on opposite sides of said center table;

said conveyer means being adapted to feed a group of said articles to each of said side tables at said upstream portion;

said pusher means being adapted to force said articles from said upstream portion to said downstream portion for subsequent packaging and comprising a center pusher at said center table, and a pair of side pushers at said side tables, said side pushers being positioned in opposing relationship and movable toward and away from each other, and said center pusher being positioned between said side pushers and movable between upstream and downstream positions in a direction normal to directional movement of said side pushers; and said control means being adapted to coordinate movement of said center pusher and said side pushers in a manner whereby a group of articles fed by said conveyor means to one of said side tables is moved by the respective side pusher to said center table and by said center pusher downstream for subsequent packaging alternately with a group of articles fed by said conveyor means to the other of said side tables.

2. An apparatus according to claim 1 wherein said conveyor means is adapted to feed said articles to each of said side tables seriatim to form a row of articles on each of said side tables; and said control means is further adapted to move each of said side pushers a relatively short distance on the respective side table to move a first row of articles a sufficient distance to enable a second row of articles to be fed to said side table just upstream of said first row, whereby a predetermined number of rows can be grouped on said side table prior to said group being moved by said side pusher to said center table.

3. An apparatus according to claim 2, wherein said control means is further adapted to actuate movement of one of said side pushers to move successive groups of rows of said articles from said respective side table to said center table prior to actuating movement of said other of said side pushers.

4. An apparatus according to claim 2, further comprising a first detection means at each of said side tables for detecting the presence of said first row of said articles thereon;

said control means being operatively connected to said first detection means and is adapted to respond to the detected presence of said first row on said side table to actuate movement of the respective side pusher to advance said first row downstream said relatively short distance.

5. An apparatus according to claim 4, further comprising at each of said side tables a second detection means for detecting movement of the respective side pusher said relatively short distance;

said control means being operatively connected to said second detection means and adapted to respond to the detected movement of said side pusher said relatively short distance to move said side pusher upstream to an initial position; and said apparatus further comprising a third detection means for detecting the presence of said side pusher at said initial position.

6. An apparatus according to claim 5, wherein said control means further comprises a counter means for counting said relatively short distance movements of each of said side pushers between said second and third detection means, said control means being further adapted to actuate movement of said side pusher through a relatively long distance to move a group of rows of said articles from the respective side table to said center table after a predetermined number of counts of said counter means.

7. An apparatus according to claim 6, further comprising a fourth detection means at each of said side tables for detecting the movement of the respective side pusher through said relatively long distance;

said control means being operatively connected to said fourth detection means and adapted to respond to the detected movement of said side pusher through said relatively long distance to move said side pusher upstream to said initial position.

8. An apparatus according to claim 7, wherein said control means further comprises a resetting means operatively connected to each of said fourth detection means and said counter means and responsive to movement of the respective said pusher through said relatively long distance at said respective side table for resetting said counter means.

9. An apparatus according to claim 8, wherein each of said side pushers further comprises a first interference means for interfering with seriatim feeding of said articles to the respective side table by said conveyor means when said side pusher is moved said relatively short distance.

10. An apparatus according to claim 9, further comprising a second interference means movably mounted to each of said side tables for interfering with seriatim feeding of said articles to the respective side table by said conveyor means when the respective side pusher is moved downstream through said relatively long distance;

said controller means being responsive to such downstream movement of said side pusher to move said second interference means into a position of interference with feeding of said articles to said side table.

11. An apparatus according to claim 7, further comprising gate means at each of said opposite sides of said center table, said gate means being movable between raised and lowered positions to obstruct and permit, respectively, movement of said articles from the respective side table to said center table;

said control means being further adapted to actuate movement of each of said gate means from said raised position to said lowered position, prior to movement of the respective side pusher through said relatively long distant, and subsequently from said lowered position to said raised position, when said side pusher moves upstream to said initial position.

12. An apparatus according to claim 4, wherein said control means is further adapted to actuate movement of each of said gate means from said raised position to said lowered position after said predetermined number of counts of said counter means.

13. An apparatus according to claim 12, wherein said control means is operatively connected to each of said third detection means and is adapted to respond to the detected presence of the respective side pusher at said initial position at the respective side table to move the respective gate means to said raised position.

14. An apparatus according to claim 6, wherein said control means further comprises a manually operated fill switch means for actuating movement of said center pusher from said upstream position to said downstream position to advance a group of rows of said articles downstream for subsequent packaging after one of said side pushers has moved said group of articles from the respective side table.

15. An apparatus according to claim 14, further comprising a fifth detection means at said center table for detecting movement of said center pusher to said downstream position;

said control means being operatively connected to said fifth detection means and being responsive to detected movement of said center pusher to said downstream position to move said center pusher to said upstream position.

16. An apparatus according to claim 14, further comprising a sixth detection means for detecting movement of said center pusher to said upstream position;

said control means further comprising interlock means operatively connected to said sixth detection means and responsive to detected movement of said center pusher to said upstream position to thereafter prevent movement of said center pusher to said downstream position until said fill switch means is actuated.

17. An apparatus according to claim 14, wherein said apparatus is adapted to package said articles into a bag having an open end;

said apparatus also comprises bag holder means disposed at said downstream portion for supporting said bag on said table means with said open end facing said upstream portion;

said pusher means is adapted to force said articles from said center table into said bag when said pusher means is moved from upstream portion to said downstream portion;

said apparatus further comprises sealing means at said downstream portion for sealing said bag open end, said sealing means comprising a pair of opposed sealing jaws positioned adjacent to said open end of said bag, and means for mounting said sealing jaws for movement between an open position where said jaws are positioned in spaced-apart relationship and a clamping position where said jaws engage on another; and said control means is further adapted to actuate movement of said sealing jaws from said open position to said clamping position under a first pressure when said center pusher moves from said downstream position to said upstream position.

18. An apparatus according to claim 17, wherein said control means further comprises a manually operated palm button means for actuating movement of said sealing jaws from said open position to said clamping position under said first pressure.

19. An apparatus according to claim 18, further comprising a seventh detection means for detecting the presence of said sealing jaws in said clamping position;

said control means being operatively connected to said seventh detection means and adapted to respond to the detected presence of said sealing jaws in said clamping position to drive said sealing jaws together under a second pressure greater than said first pressure.

20. An apparatus according to claim 19, wherein said sealing means further comprises a thermal severing means for applying heat to said open end of said bag to seal said bag and sever excess material therefrom at said seal; and said control means is further responsive to the detected presence of said sealing jaws in said clamping position to activate said thermal severing means to apply heat to said bag.

21. An apparatus according to claim 20, wherein said control means further comprises a first timer means operatively connected to said palm button means and responsive to activation of said palm button means for measuring a first predetermined time period; and is further responsive to said first timer means to move said jaws to said open position when said first time period ends prior to the detection of said jaws in said clamping position by said seventh detection means.

22. An apparatus according to claim 21, wherein said sealing jaws are adapted to be driven under said first pressure and said second pressure at approximately 20 p.s.i. and 80 p.s.i., respectively.

23. An apparatus according to claim 17, wherein said open end of said bag further comprises upper and lower portions; and said bag holder means is positioned upstream of said sealing means and comprises an upper holder means for holding said upper portion above said center table and a lower holder means for holding said lower portion below said center table.

24. An apparatus according to claim 23, wherein said lower holder means further comprises feet means movable between a bottom position where said feet means are out of engagement with said center table and a top position where said feet means engage said center table for securely clamping said lower portion of said bag between said center table and said feet means; and said upper holder means further comprises bucket means pivotable between a lower position wherein said bucket means is adapted to receive said upper portion of said bag and an upper position wherein said bucket means securely holds said upper portion of said bag above said center table.

25. An apparatus according to claim 24, wherein said control means is further adapted to actuate movement of said feet and bucket means between said bottom and lower positions and said top and upper positions, respectively, the control means further comprising a manually operated foot switch means for actuating movement of said feet and bucket means to said bottom and lower postions, respectively, when said foot switch means is activated, and for actuating movement of said feet and bucket means to said top and upper positions, respectively, when said foot switch means is deactivated.

26. An apparatus according to claim 25, wherein said control means further comprises a second timer means operatively connected to said foot switch means for measuring a second predetermined time period when said foot switch means is deactivated; and said control means is further responsive to said second timer means to move said bucket means to said upper position at the expiration of said second time period.

27. An apparatus according to claim 1, wherein said apparatus is adapted to package said articles into a bag having an open end;

said apparatus also comprises bag holder means disposed at said downstream portion for supporting said bag on said table means with said open end facing said upstream portion;

said pusher means is adapted to force said articles from said center table into said bag when said pusher means is moved from said upstream portion to said downstream portion;

said apparatus further comprises sealing means at said downstream portion for sealing said bag open end, said sealing means comprising a pair of opposed sealing jaws positioned adjacent to said open end of said bag; and a means for mounting said sealing jaws for movement between an open position wherein said jaws are positioned in spaced-apart relationship and a clamping position wherein said jaws engage one another; and said control means is further adapted to move said sealing jaws from said open position to said clamping position under a first pressure after said center pusher moves to said downstream position.

28. An apparatus according to claim 27, wherein said control means further comprises a manually operated palm button means for actuating movement of said sealing jaws from said open position to said clamping position under said first pressure.

29. An apparatus according to claim 28, further comprising a detection means for detecting the presence of said sealing jaws in said clamping position;

said control means being operatively connected to said detection means and adapted to respond to the detected presence of said sealing jaws in said clamping position to drive said sealing jaws under a second pressure greater than said first pressure.

30. An apparatus according to claim 27, wherein said sealing means further comprises a thermal severing means for applying heat to said open end of said bag to seal said bag and sever excess material from said bag at said seal; and said control means is further responsive to the detected presence of said sealing jaws in said clamping position to activate said thermal severing means to apply heat to said bag.

31. An apparatus according to claim 30, wherein said control means further comprises a timer means responsive to actuation of said palm button means for measuring a predetermined time period; and is further responsive to said timer means to move said jaws to said open position when said time period ends prior to the detection of said jaws in said clamping position by said detection means.

32. An apparatus according to claim 1, wherein said apparatus is adapted to package said articles into a bag having an open end, said open end of said bag comprising upper and lower portions;

said apparats further comprises bag holder means disposed at said downstream portion for supporting said bag on said table means with said open end facing said upstream portion;

said bag holder means comprises an upper holder means for holding said upper portion above said center table and a lower holder means for holding said lower portion below said center table; and said pusher means is adapted to force said articles from said center table into said bag when said pusher means is moved from said upstream portion to said downstream portion.

33. An apparatus according to claim 32, wherein said lower holder means further comprises feet means movable between a bottom position wherein said feet means are out of engagement with said center table and a top position wherein said feet means engage said center table for securely clamping said lower portion of said bag between said center table and said feet means; and said upper holding means further comprises bucket means pivotable between a lower position wherein said bucket means is adapted to receive said upper portion of said bag and an upper position wherein said bucket means is adapted to securely hole said upper portion of said bag above said center table.

34. An apparatus according to claim 33, wherein said control means is further adapted to actuate movement of said feet and bucket means between said bottom and lower positions and said top and upper positions, respectively, the control means further comprising a manually operated foot switch means for actuating movement of said feet and bucket means to said bottom and lower positions, respectively, when said foot switch means is activated, and to move said feet and bucket means to said top and upper positions, respectively, when said foot switch means is deactivated.

35. An apparatus according to claim 34, wherein said control means further comprises a timer means operatively connected to said foot switch means for measuring a predetermined time period when said foot switch means is deactivated; and is further responsive to said timer means to move said bucket means to said upper position at the expiration of said second time period.

36. An apparatus according to claim 1, further comprising gate means at each of said opposite longitudinal sides of said center table, said gate means being movable between raised and lowered positions to obstruct and permit, respectively, movement of said articles from the respective side table to said center table;

said control means being further adapted to actuate movement of each of said gate means from said raised position to said lower position, prior to movement of the respective side pusher toward said center table, and subsequently from said lowered position to said raised portion, when said side pusher is moved to a position away from said center table.

37. An apparatus according to claim 36, wherein said gate means are slidably mounted for vertical movement to said opposite longitudinal sides of said center table for movement between said raised and lowered positions.

38. A method for packaging articles, comprising the steps of:

feeding said articles in groups to a pair of side stations positioned on opposite sides of a center station; and moving group of said articles from one of said side stations in a first direction to said center station and from said center station in a second direction normal to said first direction for subsequent packaging alternately with a group of said articles from the other of said side stations.

39. A method according to claim 38, wherein said articles are fed seriatim to each of said side stations to form a row of said articles at each of said side stations and including the steps of:

moving a first row of articles on each of said side stations a short distance to permit the feeding of a second row of articles at each of said side stations adjacent said first row;

continuing the foregoing steps of moving rows of said articles a short distance and feeding another row of said articles at each of said side stations until a group of rows of said articles are formed at each of said side stations; and moving a group of rows of said articles from one of said side stations to said center station in said first direction for subsequent packaging alternately with a group of rows of said articles from the other of said side stations.

40. A method according to claim 39, wherein successive groups of rows of said articles from one of said side stations are moved to said center station prior to moving at least one group of rows of said articles from the other of said side stations to said center station.

* * * * *

UNITED STATES PATENT AND TRADEMARK OFFICE

CERTIFICATE OF CORRECTION

PATENT NO. :4,976,090

DATED :December 11, 1990

INVENTOR(S) :BRYAN K. PORTER, MARVIN J. JAKUBIAK and JERRY A. BOTT

It is certified that error appears in the above-identified patent and that said Letters Patent is hereby corrected as shown below:

Claim 1, Col. 17, line 65, before "and" insert --pusher means,--.

Claim 12, Col. 19, line 55, "4," should be --11,--.

Claim 16, Col. 20, line 15, "14," should be --15,--.

Claim 17, Col. 20, line 25, "14," should be --15,--.

Claim 30, Col. 22, line 29, "27," should be --29,--.

Claim 32, Col 22, line 50, "apparats" should be --apparatus--.

Claim 33, Col. 23, line 5, "hole" should be --hold--.

Claim 38, Col. 24, line 10, after "moving" insert --a--.

Signed and Sealed this

Thirtieth Day of June, 1992

*Attest:*

DOUGLAS B. COMER

*Attesting Officer*

*Acting Commissioner of Patents and Trademarks*